US009849048B2

(12) United States Patent
Borisoff et al.

(10) Patent No.: US 9,849,048 B2
(45) Date of Patent: Dec. 26, 2017

(54) MOBILITY SYSTEM INCLUDING AN EXOSKELETON ASSEMBLY RELEASABLY SUPPORTED ON A WHEELED BASE

(71) Applicant: British Columbia Institute of Technology, Burnaby (CA)

(72) Inventors: Jaimie Borisoff, Burnaby (CA); Vince Rafer, Port Coquitlam (CA)

(73) Assignee: British Columbia Institute of Technology, Burnaby, British Columbia ( * ) Notice: Subject to any disclaimer, the term of this patent is extended or adjusted under 35 U.S.C. 154(b) by 272 days.

(21) Appl. No.: 14/440,195

(22) PCT Filed: Nov. 1, 2013

(86) PCT No.: PCT/CA2013/050836

§ 371 (c)(1),
(2) Date: May 1, 2015

(87) PCT Pub. No.: WO2014/067015

PCT Pub. Date: May 8, 2014

(65) Prior Publication Data

US 2015/0283009 A1 Oct. 8, 2015

Related U.S. Application Data

(60) Provisional application No. 61/721,091, filed on Nov. 1, 2012.

(51) Int. Cl.
*A61G 5/14* (2006.01)
*A61G 5/10* (2006.01)
(Continued)

(52) U.S. Cl.
CPC ..... *A61G 5/10* (2013.01); *A61G 5/1054* (2016.11); *A61G 5/14* (2013.01); *A61H 1/024* (2013.01);
(Continued)

(58) Field of Classification Search
CPC ..... A61G 5/14; A61H 3/04; A61H 1/0262; A61H 1/0237; A61F 5/0123; A61F 5/0125
(Continued)

(56) References Cited

U.S. PATENT DOCUMENTS 4,390,076 A 6/1983 Wier
5,387,184 A * 2/1995 Seitz ..... A61F 5/0102 602/23
(Continued)

FOREIGN PATENT DOCUMENTS

CN 100548256 10/2009
EP 2193774 6/2010
(Continued)

*Primary Examiner* — Keri J Nelson
(74) *Attorney, Agent, or Firm* — Ryan W. Dupuis; Ade & Company Inc.

(57) ABSTRACT

A mobility system includes a wheeled base, an exoskeleton assembly, and a docking assembly arranged to support the exoskeleton assembly on the wheeled base. The exoskeleton assembly has an upper torso portion, upper leg portions pivotal relative to the torso portion and lower leg portions pivotal relative to respective ones of the upper leg portions. The docking assembly is operable to couple the exoskeleton assembly to the wheeled base in a sitting position. The seating surface in the sitting position and the position control motors for operating the exoskeleton from sitting to standing are all separable from the wheeled base together with the exoskeleton assembly. Alternatively, extensible links may dock the standing exoskeleton to the wheeled base so that the base can trail the exoskeleton through a walking motion.

20 Claims, 15 Drawing Sheets

(51) Int. Cl.
*A61H 1/02* (2006.01)
*A61H 3/04* (2006.01)
*A61H 3/02* (2006.01)

(52) U.S. Cl.
CPC ..... *A61H 1/0244* (2013.01); *A61H 1/0262* (2013.01); *A61H 3/0244* (2013.01); *A61H 3/04* (2013.01); *A61H 2201/0107* (2013.01); *A61H 2201/0161* (2013.01); *A61H 2201/163* (2013.01); *A61H 2201/164* (2013.01)

(58) Field of Classification Search
USPC ..... 601/5; 602/16, 23, 26
See application file for complete search history.

(56) References Cited

U.S. PATENT DOCUMENTS

| | | | | |
|---|---|---|---|---|
| 7,452,342 | B2 * | 11/2008 | Bonutti ..... | A61F 5/0102 602/16 |
| 2010/0271051 | A1 * | 10/2010 | Sankai ..... | A61B 5/1038 324/679 |

FOREIGN PATENT DOCUMENTS

| | | |
|---|---|---|
| EP | 2361734 | 8/2011 |
| GB | 2166048 | 4/1986 |
| WO | 2006078871 | 7/2006 |

* cited by examiner

MOBILITY SYSTEM INCLUDING AN EXOSKELETON ASSEMBLY RELEASABLY SUPPORTED ON A WHEELED BASE

FIELD OF THE INVENTION

The present invention relates to a mobility system for providing mobility assistance to a user in which the mobility system includes a wheeled base and an exoskeleton assembly including an upper torso portion, an intermediate thigh portion and a lower leg potion arranged to be braced to the torso, thighs and calves of the user respectively, and more particularly the present invention relates to a mobility system in which the exoskeleton is movable relative to the wheeled base between sitting and standing positions and the exoskeleton is readily separable from the wheeled base in the standing position.

BACKGROUND

Perhaps the most obvious result that often follows spinal cord injury (SCI) and disease is the inability to walk. This functional deficit, for which the simple and widespread solution is the use of wheelchairs, has profound consequences to quality of life for at least two major reasons: 1) Health—seated wheelchair use is associated with a variety of health concerns such as skin integrity and overuse injuries; and 2) Access—wheelchair dependence impacts community participation and interaction with others due to the inherent inaccessible nature of the man-made and natural environments in which we live.

Since our world is designed and built primarily for upright walking and standing, the use of conventional wheelchairs is limiting, both in terms of moving from place to place (at home and in the community), and perhaps more importantly, in terms of full and meaningful interaction with the environment and other people throughout one's normal daily activities (e.g. standing face to face). Current assistive technologies (AT) for mobility are simply not transformative, that is enabling a person with a disability a level of mobility performance approaching that of their non-disabled peers.

Two evolving mobility concepts include dynamic wheeled mobility and powered walking exoskeletons.

The first concept of dynamic wheeled mobility is exemplified in the marketplace by specialized standing and/or tilt/recline wheelchairs (both manual and powered), as well as the recently developed and commercialized "Elevation" wheelchair. Lightweight rigid manual wheelchairs, as well as modern high-end power wheelchairs, are often desired by people with SCI due to their efficient propulsion dynamics and usability, and represent an efficient means of everyday mobility for full-time wheelchair users. The addition of dynamic seating features (e.g. the capability for a user to independently and quickly adjust their seat position during normal seated usage) to wheelchairs offers greater function for activities of daily living, potential health benefits, increased community participation, and improved interaction with other people.

The second concept of powered walking exoskeletons provides a highly desired walking function that wheelchairs are not able to provide. Perhaps the two most well-known exoskeleton models are the ReWalk and Ekso systems. The development of exoskeletons aims to provide walking function to people with SCI, although they are presently typically used only under strict supervision in rehabilitation centers. Currently, their therapeutic use is hoped to provide benefits such as improved bowel and bladder function and decreased spasticity. Exoskeletons are a rapidly developing technology which may lead to solutions for some of the physical access issues described above, and with the potential for beneficial impacts on general health, gait training and rehabilitation following injury. However, the cumbersome slow gait and short travel range currently limit their use as a general purpose daily mobility device. As well, there are significant usability issues with these designs that have not yet been addressed, such as transferring into and out of the device and seating support for preventing skin breakdown associated with long term use.

SUMMARY OF THE INVENTION

According to one aspect of the invention there is provided a mobility system for providing mobility assistance to a user, the system comprising a wheeled base, an exoskeleton assembly, and a docking assembly arranged to selectively support the exoskeleton assembly on the wheeled base, the wheeled base comprising a base frame and wheels supporting the base frame for rolling movement along the ground and the exoskeleton assembly comprising:

an upper portion arranged to be braced to a torso of a user; an intermediate portion arranged to be braced to thighs of the user;

a hip joint pivotally coupling the intermediate portion to the upper portion;

a lower portion arranged to be braced to lower legs of user; and a knee joint pivotally coupling the lower leg portion to the intermediate portion;

the docking assembly being operable between a coupled position in which the exoskeleton assembly is coupled to the wheeled base and the exoskeleton assembly is movable relative to the wheeled base between respective standing and sitting positions and a released position in which the exoskeleton assembly is readily separable from the wheeled base in the standing position of the exoskeleton assembly.

Preferably the exoskeleton further comprises a position control motor unit associated with each of the hip and knee joints which is separable from the wheeled base together with the exoskeleton assembly. In this instance, the exoskeleton is preferably movable relative to the wheeled base between the standing position and the sitting position in the coupled position of the docking assembly solely under control of the position control motor units.

Preferably the exoskeleton assembly is further arranged to be supported relative to the wheeled base at any one of a plurality of intermediate positions between the sitting position and the standing position using the position control motor units of the exoskeleton assembly in which the intermediate portion extends at an upward inclination from the lower portion to the upper portion through the full range of the intermediate positions when the intermediate portions are horizontal in the sitting position. In a dumped sitting position, some of the intermediate positions may be inclined rearward from the lower portion to the upper portion, but the majority of the range of intermediate positions would remain at an upward inclination.

The present invention merges the two evolving mobility concepts, dynamic wheeled mobility and powered walking exoskeletons, into a coherent new device suitable for daily use for people with SCI. The resulting mobility system merges the best features of walking exoskeletons with the benefits of wheeled mobility into the creation of a novel mobility device that could make a significant leap forward to the mobility and life of people with SCI or any other mobility impairment.

Potential benefits and functions of the mobility system according to the present invention include the following:

i) wheelchair seating comparable to existing modern wheelchairs that efficiently facilitate normal activities of daily living for people with SCI;

ii) easy transfers into and out;

iii) seating support adequate for all day sitting and pressure relief;

iv) long-range propulsion dynamics like that of a manual rigid wheelchair;

v) efficient mobility from place to place to facilitate community participation;

vi) manual (powerless) mobility eliminating risk of becoming stranded;

vii) full dynamic range of seating positions accessible in real-time during normal wheelchair use;

viii) declined seat height for optimal wheeling position in a "dumped" seat;

ix) level sitting suitable for most tasks and activities in a wheelchair;

x) elevated sitting for sitting high e.g. at counters and reaching shelves;

xi) standing while attached to the wheels, e.g. for simple quick face to face interaction;

xii) detachable powered exoskeleton functions for walking sojourns, using the wheeled frame as a walker if desired;

xiii) walking upright with the wheeled frame or crutches;

xiv) greater access in a world designed for upright ambulation, including stairs;

xv) built-in seating support for safe sitting anywhere after walking to a destination;

xvi) fall protection for the hips and sacrum via built-in orthotic seating; and xvii) rehabilitation through robotic gait training accessible easily and daily.

According to another aspect of the present invention there is provided a mobility system for providing mobility assistance to a user, the system comprising a wheeled base, an exoskeleton assembly, and a docking assembly arranged to support the exoskeleton assembly on the wheeled base such that the exoskeleton assembly is movable relative to the wheeled base between respective standing and sitting positions, wherein:

the wheeled base comprises a base frame and wheels supporting the base frame for rolling movement along the ground;

the exoskeleton assembly comprises:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user; and a knee joint pivotally coupling the lower leg portion to the intermediate portion; and the docking assembly comprises:

at least one lower docking member which is coupled between the lower portion of the exoskeleton assembly and the wheeled base throughout movement of the exoskeleton assembly between the sitting position and the standing position; and at least one upper docking member which is coupled between the intermediate portion of the exoskeleton assembly and the wheeled base in the sitting position;

said at least one upper docking member being arranged to be releasable as the exoskeleton is displaced towards the standing position;

whereby in the standing position, the docking assembly is only coupled by said at least one lower docking member between the wheeled base and the lower portion of the exoskeleton assembly.

According to a further aspect of the present invention there is provided a mobility system for providing mobility assistance to a user, the system comprising a wheeled base and an exoskeleton assembly arranged to be supported on the wheeled base such that the exoskeleton assembly is movable relative to the wheeled base between respective standing and sitting positions, the wheeled base comprising a base frame and wheels supporting the base frame for rolling movement along the ground and the exoskeleton assembly comprising:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user;

a knee joint pivotally coupling the lower leg portion to the intermediate portion; and a seating surface arranged to support the user seated thereon in the sitting position of the exoskeleton assembly;

the seating surface being supported on the intermediate portion so as to be pivotal together with the intermediate portion relative to the upper portion about a hip axis of the hip joint and so as to be pivotal together with the intermediate portion relative to the lower portion about a knee axis of the knee joint;

the hip joint of the exoskeleton assembly being arranged to align the hip axis with a hip joint of the user; and the knee joint of the exoskeleton assembly being arranged to align the knee axis with a knee joint of the user.

According to yet another aspect of the present invention there is provided a mobility system for providing mobility assistance to a user, the system comprising a wheeled base, an exoskeleton assembly, and a docking assembly arranged to support the exoskeleton assembly on the wheeled base such that the exoskeleton assembly is movable relative to the wheeled base between respective standing and sitting positions, wherein:

the wheeled base comprises a base frame and wheels supporting the base frame for rolling movement along the ground;

the exoskeleton assembly comprises:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user; and a knee joint pivotally coupling the lower leg portion to the intermediate portion; and the lower portion of the exoskeleton assembly comprising two independent lower leg members arranged to be braced to respective ones of the lower legs of the user; and the docking assembly comprising a pair of lower docking members arranged to be coupled to respective ones of the two lower leg members independently of one another, each lower docking member comprising an extensible link in the coupled position of the docking assembly which is extendible in length between the exoskeleton assembly and the wheeled base.

In this instance, each extensible link may comprise either a powered linear actuator, or alternatively, a passively extendible member. In either instance, each extensible link is preferably pivotally coupled relative to the exoskeleton assembly and relative to the wheeled base. Furthermore, the extensible links are preferably independently extendable relative to one another such that the lower docking members are arranged to remain coupled between the wheeled base and the exoskeleton assembly during a walking motion of the exoskeleton assembly.

According to all aspects of the invention noted above, preferably the docking assembly is only coupled between the wheeled base and the lower portion of the exoskeleton assembly in the standing position.

When the lower portion of the exoskeleton assembly comprises two independent lower leg members arranged to be braced to respective ones of the lower legs of the user, the docking assembly preferably includes a pair of lower docking members arranged to be coupled to respective ones of the two lower leg members independently of one another in which at least one of the lower docking members provides relative pivotal movement between the exoskeleton assembly and the wheeled base about a vertical axis when the other lower docking member is released.

Preferably the docking assembly is arranged to be engaged between the wheeled base and each of the lower portion and the intermediate portion of the exoskeleton in the sitting position.

When the docking assembly includes at least one lower docking member which is pivotally coupled between the lower portion of the exoskeleton assembly and the wheeled base throughout movement of the exoskeleton assembly between the sitting position and the standing position and at least one upper docking member which is engaged between the intermediate portion of the exoskeleton assembly and the wheeled base in the sitting position, preferably said at least one upper docking member is arranged to be releasable as the exoskeleton is displaced towards the standing position, whereby in the standing position the docking assembly is only engaged by said at least one lower docking member between the wheeled base and the lower portion of the exoskeleton assembly.

When the docking assembly includes at least one lower docking member which is pivotally coupled between the lower portion of the exoskeleton assembly and the wheeled base throughout movement of the exoskeleton assembly between the standing position and the sitting position, preferably said at least one lower docking member comprises a linkage arranged to passively raise the lower portion of the exoskeleton assembly relative to the wheeled base as the exoskeleton assembly is displaced towards the sitting position.

When the docking assembly further comprises at least one upper docking member which is arranged to engage the intermediate portion of the exoskeleton assembly such that the intermediate portion is generally pivotally supported relative to the wheeled base at a location on the intermediate portion spaced from the knee joint between the knee joint and the hip joint as the exoskeleton assembly approaches the sitting position, preferably said at least one lower docking member comprises a link member which is pivotally coupled to the wheeled base at a first end and extends generally forwardly to a second end pivotally coupled to the lower portion of the exoskeleton assembly.

When the lower portion of the exoskeleton assembly comprises two independent lower leg members arranged to be braced to respective ones of the lower legs of the user, preferably the docking assembly includes a pair of lower docking members arranged to be coupled to respective ones of the two lower leg members independently of one another in which each lower docking member comprises an extensible link in the coupled position of the docking assembly which is extendible in length between the exoskeleton assembly and the wheeled base.

Each extensible link may comprise a powered linear actuator, or alternatively, a passively extendible member.

Preferably each extensible link is pivotally coupled relative to the exoskeleton assembly and relative to the wheeled base.

Preferably the extensible links are independently extendable relative to one another such that the lower docking members are arranged to remain coupled between the wheeled base and the exoskeleton assembly during a walking motion of the exoskeleton assembly.

When the system further comprises a seating surface arranged to support the user seated thereon in the sitting position of the exoskeleton assembly, the seating surface is preferably supported on the intermediate portion of the exoskeleton assembly for separation from the wheeled base together with the exoskeleton assembly in the released position of the docking assembly.

When the intermediate portion comprises two upper leg members independently pivotally connected to the upper portion, preferably the seating surface comprises a pair of seat members supported on the two upper leg members respectively so as to be arranged to support respective thighs of the user thereon in the sitting position.

Furthermore, the seating surface is preferably supported on the intermediate portion so as to be pivotal together with the intermediate portion relative to the upper portion about a hip axis of the hip joint and so as to be pivotal together with the intermediate portion relative to the lower portion about a knee axis of the knee joint, the hip joint of the exoskeleton assembly being arranged to align the hip axis with a hip joint of the user and the knee joint of the exoskeleton assembly being arranged to align the knee axis with a knee joint of the user.

Preferably the docking assembly is arranged for connection to the base frame and the wheeled base consists only of the base frame and the wheels.

Preferably the base frame of the wheeled base comprises two laterally spaced apart side frames supported on respective ones of the wheels and at least one cross member extending laterally between the side frames.

When the intermediate portion of the exoskeleton comprises two upper leg members independently pivotally connected to the upper portion by respective pivot connections of the hip joint and the lower portion comprises two lower leg members independently pivotally connected to respective ones of the upper leg members by respective pivot connections of the knee joint, preferably the system further comprises a pair of seat members supported on the two upper leg members respectively so as to be arranged to support respective thighs of the user thereon in the seated position. According to one embodiment, in this instance at least one of the upper leg members includes an access portion which is movable between a working position in which the access portion extends above the respective seat member adjacent of forward end of the seat member in the sitting position so as to be arranged to extend alongside an outer side of the thigh of the user in the sitting position and an access position in which the access portion is spaced from the working position such that the respective seat member is substantially laterally unobstructed adjacent the forward end.

The access portion of said at least one upper leg member preferably includes the respective pivot connection of the knee joint and a portion of the respective lower leg member which are movable together therewith between the working position and the access position. Preferably the docking assembly remains fixedly engaged with a main portion of said at least one upper leg member in the sitting position of the exoskeleton assembly as the access portion is displaced between the working position and the access position.

Alternatively, when the intermediate portion of the exoskeleton comprises two upper leg members independently pivotally connected to the upper portion by respective pivot connections of the hip joint and the lower portion comprises two lower leg members independently connected to respective ones of the upper leg members by respective pivot connections of the knee joint, each pivot connection of the knee joint may instead comprise a linkage defining a respective pivot axis of the relative movement between the respective lower leg member and the respective upper leg member from the sitting position to the standing position of the exoskeleton. In this instance the linkage which is preferably open at the pivot axis in the sitting position such that the knee joint is unobstructed by the linkage at the pivot axis in the sitting position.

In the illustrated embodiment of the mobility system, the linkage of each pivot connection comprises: i) an arcuate member fixed to a respective one of the upper leg member or the lower member and which at least partially defines an arcuate path about the pivot axis of the pivot connection; and ii) a follower fixed to another respective one of the upper leg member and the lower leg member so as to be arranged for movement along the arcuate path which is at least partially defined by the arcuate member as the lower leg member is pivoted relative to the upper leg member about the pivot axis of the pivot connection. The arcuate member may further comprise a rack of gear teeth and wherein the follower includes a pinion gear under powered control which is in meshing engagement with the rack of gear teeth.

Furthermore, in the illustrated embodiment, the linkage of each pivot connection comprises a plurality of arcuate members which are telescopically connected relative to one another between the respective upper leg member and the respective lower leg member.

According to any aspect of the invention noted above, the base frame of the wheeled base may further include a lower frame portion supported on the wheels and a pair of handles movable relative to the lower frame portion between a raised position in which the handles are near in elevational to the hip joint of the exoskeleton in the standing position and a lowered position in which the handles are lower in elevation than the raised position.

Preferably the handles are biased towards the raised position and the exoskeleton assembly is arranged to engage the handles as the exoskeleton assembly is displaced between the standing position and the sitting position such that the exoskeleton assembly is arranged to lower the handles into the lowered position as the exoskeleton assembly is displaced towards the sitting position.

According to some embodiments, each handle may be selectively separable from the wheeled base and include both a brace portion and a gripping portion longitudinally spaced apart from one another so as to be functional as a stand-alone crutch when separated from the wheeled base.

Preferably each handle is extendible in length from a docked condition arranged to be supported on the wheeled base to a working position arranged to function as a stand-alone crutch separated from the wheeled base.

According to another aspect of the present invention there is provided an exoskeleton assembly comprising:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user; and a knee joint pivotally coupling the lower leg portion to the intermediate portion;

the intermediate portion of the exoskeleton comprises two upper leg members independently pivotally connected to the upper portion by respective pivot connections of the hip joint and the lower portion comprises two lower leg members independently connected to respective ones of the upper leg members by respective pivot connections of the knee joint;

each pivot connection of the knee joint comprising a linkage defining a respective pivot axis of the relative movement between the respective lower leg member and the respective upper leg member from the sitting position to the standing position of the exoskeleton in which the linkage is open at the pivot axis in the sitting position such that the knee joint is unobstructed by the linkage at the pivot axis in the sitting position.

In the illustrated embodiment of the exoskeleton assembly, the linkage of each pivot connection comprises: i) an arcuate member fixed to a respective one of the upper leg member or the lower member and which at least partially defines an arcuate path about the pivot axis of the pivot connection; and ii) a follower fixed to another respective one of the upper leg member and the lower leg member so as to be arranged for movement along the arcuate path which is at least partially defined by the arcuate member as the lower leg member is pivoted relative to the upper leg member about the pivot axis of the pivot connection. The arcuate member may further comprise a rack of gear teeth and wherein the follower includes a pinion gear under powered control which is in meshing engagement with the rack of gear teeth.

Furthermore, in the illustrated embodiment, the linkage of each pivot connection comprises a plurality of arcuate members which are telescopically connected relative to one another between the respective upper leg member and the respective lower leg member.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
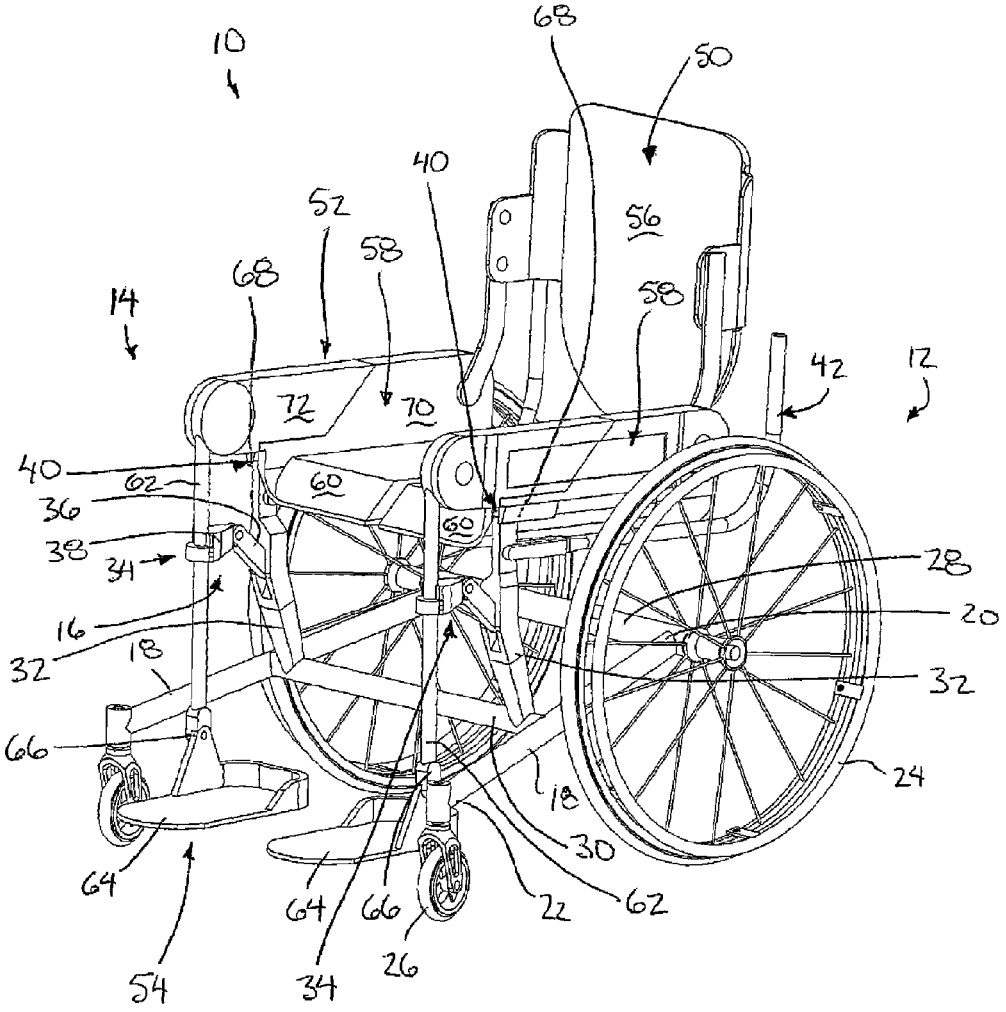
FIG. 1 is a perspective view of the mobility system in the sitting position.
Figure 2:
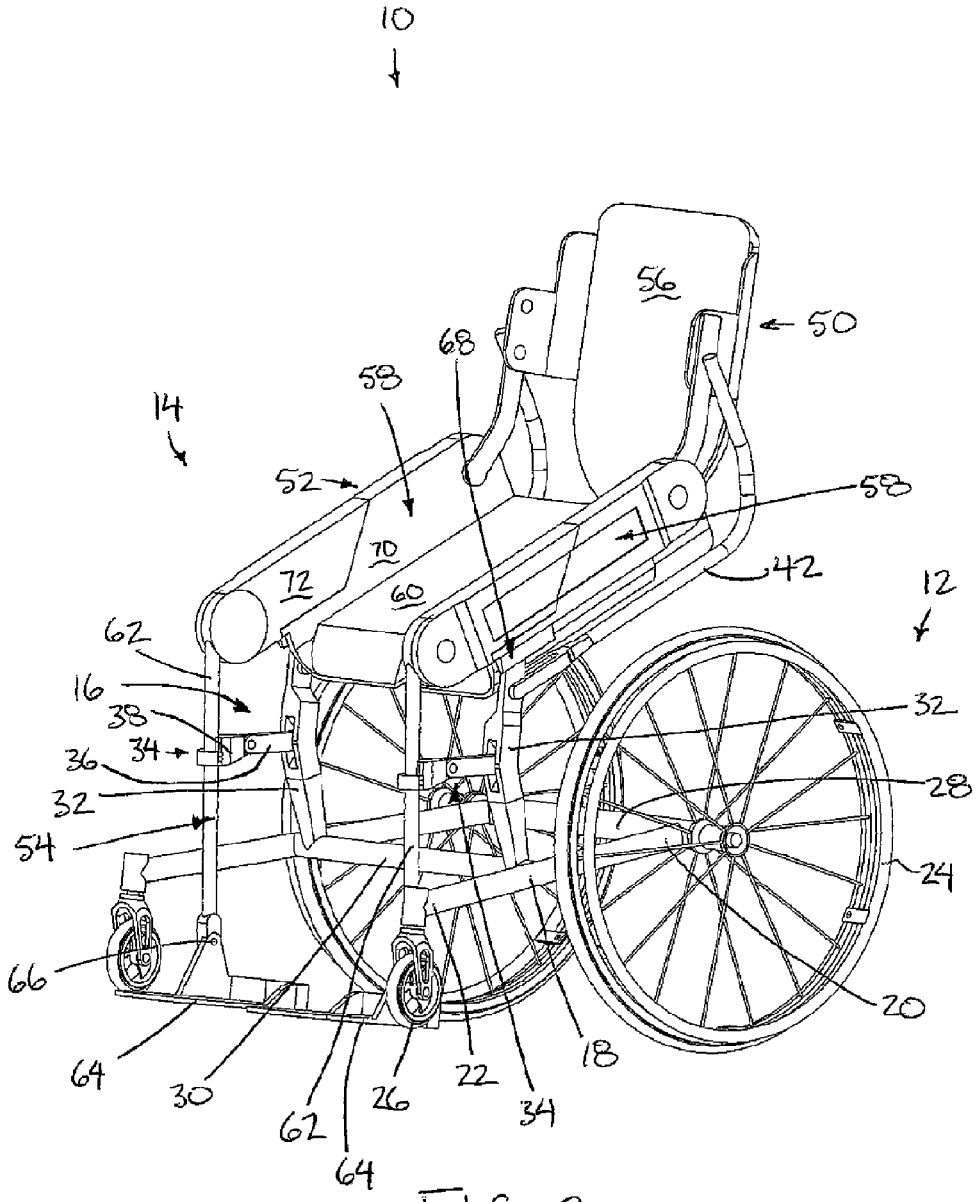
FIG. 2 is a perspective view of the mobility system in the intermediate position between the sitting and standing positions.

Referring to the accompanying figures there is illustrated a mobility system generally indicated by reference numeral 10. The mobility system provides mobility assistance to a user including both exoskeleton functions and wheelchair functions. To accomplish this, the mobility system generally comprises a wheeled base 12, a separate exoskeleton assembly 14, and a docking assembly 16 for selectively supporting the exoskeleton assembly on the wheeled base such that the exoskeleton assembly is moveable relative to the wheeled base between a standing position and a sitting position through a plurality of intermediate positions.

The wheeled base 12 generally includes a base frame having two laterally spaced apart side frames. Each side frame includes a longitudinally extending frame member 18 extending generally forwardly at a slight downward and laterally outward inclination from a rear end 20 to a forward end 22. The rear end of each side frame is supported on a respective rear wheel 24, while the forward end is supported on a respective front castor wheel 26.

A lower frame portion of the base frame further includes a rear cross member 28 extending laterally between the two side frames at a common wheel axis of the two rear wheels 24 such that the rear cross member spans between the rear ends of the two longitudinal frame members 18. A front cross member 30 also extends laterally between the two side frames at a location spaced forwardly from the rear cross member in parallel relation therewith.

The base frame further includes an upper frame portion in the form of two uprights 32 which extend generally upward from opposing ends of the front cross member 30 adjacent respective ones of the two longitudinal frame members 18 defining the side frames. Each upright 32 supports a respective lower docking member 34 of the docking assembly thereon. Each lower docking member generally includes a link member 36 pivotally connected at a rear end at an intermediate location along the height of the upright to extend generally forward to a clamp 38 pivotally connected at the opposing forward end of the link member. The pivotal connections at opposing ends of each link member are defined about respective horizontal axes so that each link member is generally movable within a vertical plane and so that the clamp members are adjustable in height as the link member pivots from a forward and downward inclination to a forward and upward inclination.

Each of the uprights 32 extends upwardly above the pivotal connection of the lower docking member to a top end near in height to the rear wheels such that the top ends 40 of the two uprights each define a respective upper docking member providing a second point of engagement of the wheeled base with the exoskeleton assembly in addition to the lower docking members noted above. The particular function of the docking members will be described in further detail below.

The wheeled base further includes two handle members 42 which are supported on the two uprights at the laterally opposed sides of the base frame. Each handle member includes a main portion pivotally connected at a first end to a respective one of the uprights 32 at an intermediate location between pivotal connection of the lower docking member and the top end defining the upper docking member. The main portion extends longitudinally from the first end to an opposing end supporting a gripping portion of the handle thereon which is oriented generally perpendicularly to the main portion.

Figure 3:
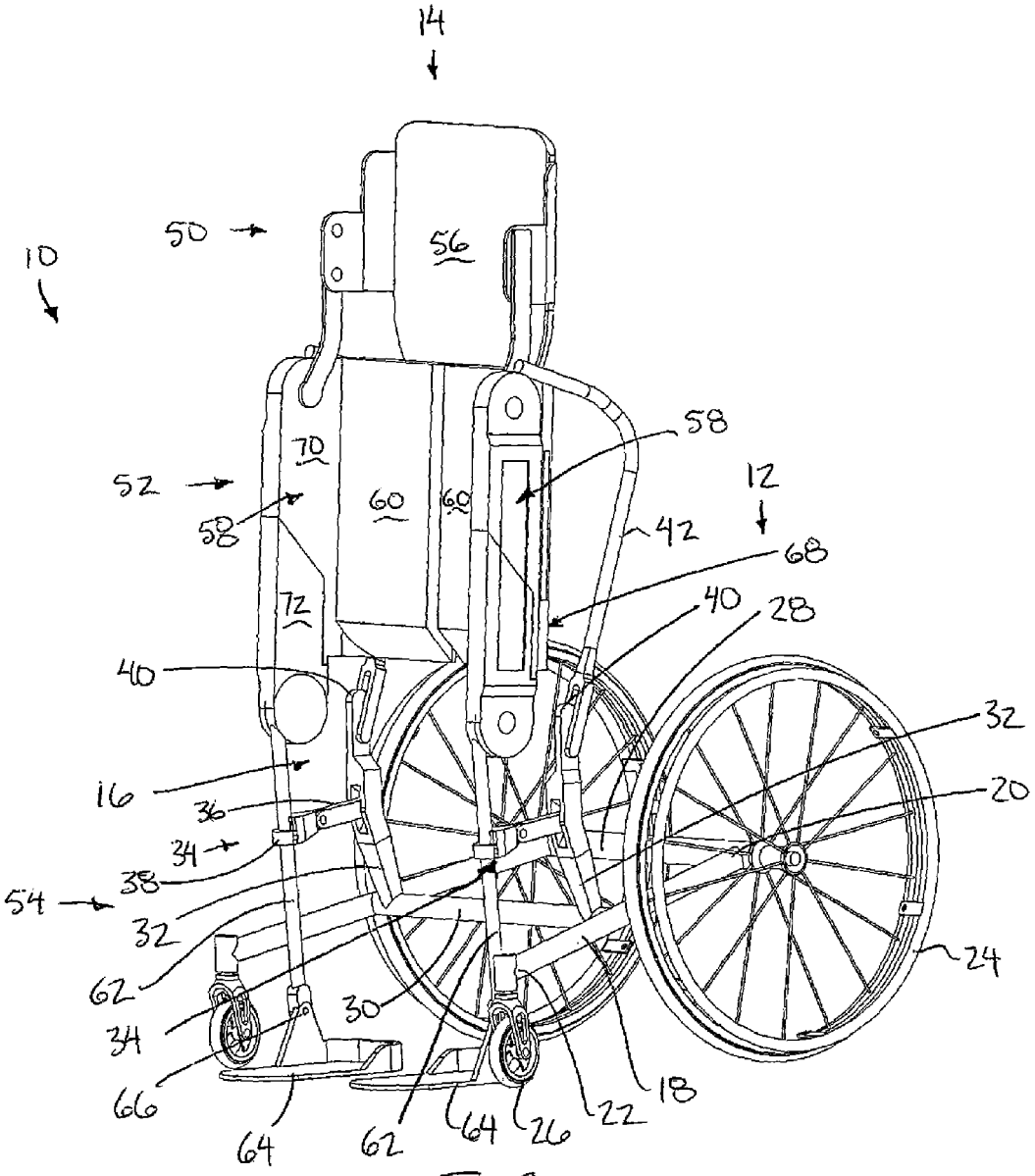
FIG. 3 is a perspective view of a front side of the mobility system in the standing position.
Figure 4:
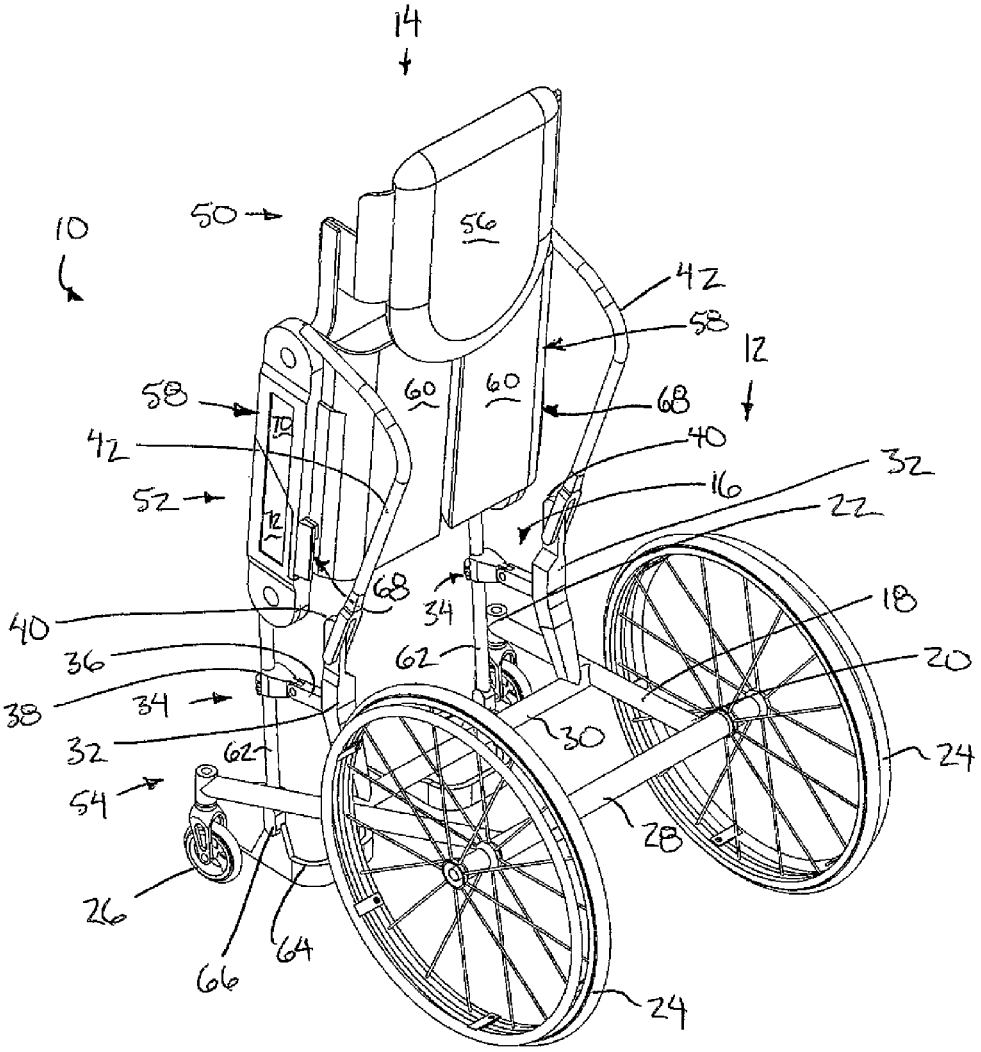
FIG. 4 is a perspective view of a rear side of the mobility system in a standing position.
Figure 5:
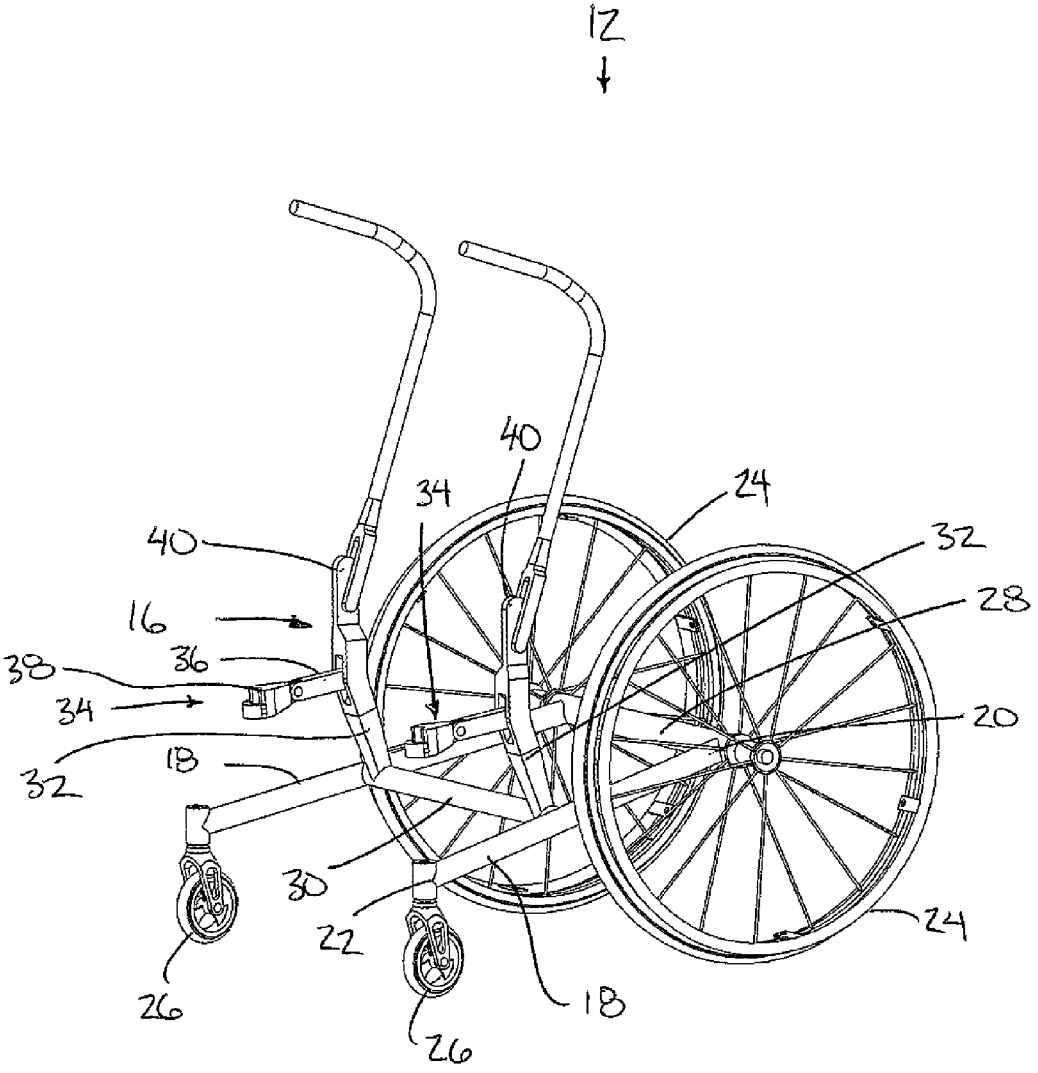
FIG. 5 is a perspective view of the wheeled base of the mobility system with the exoskeleton assembly detached therefrom.
Figure 6:
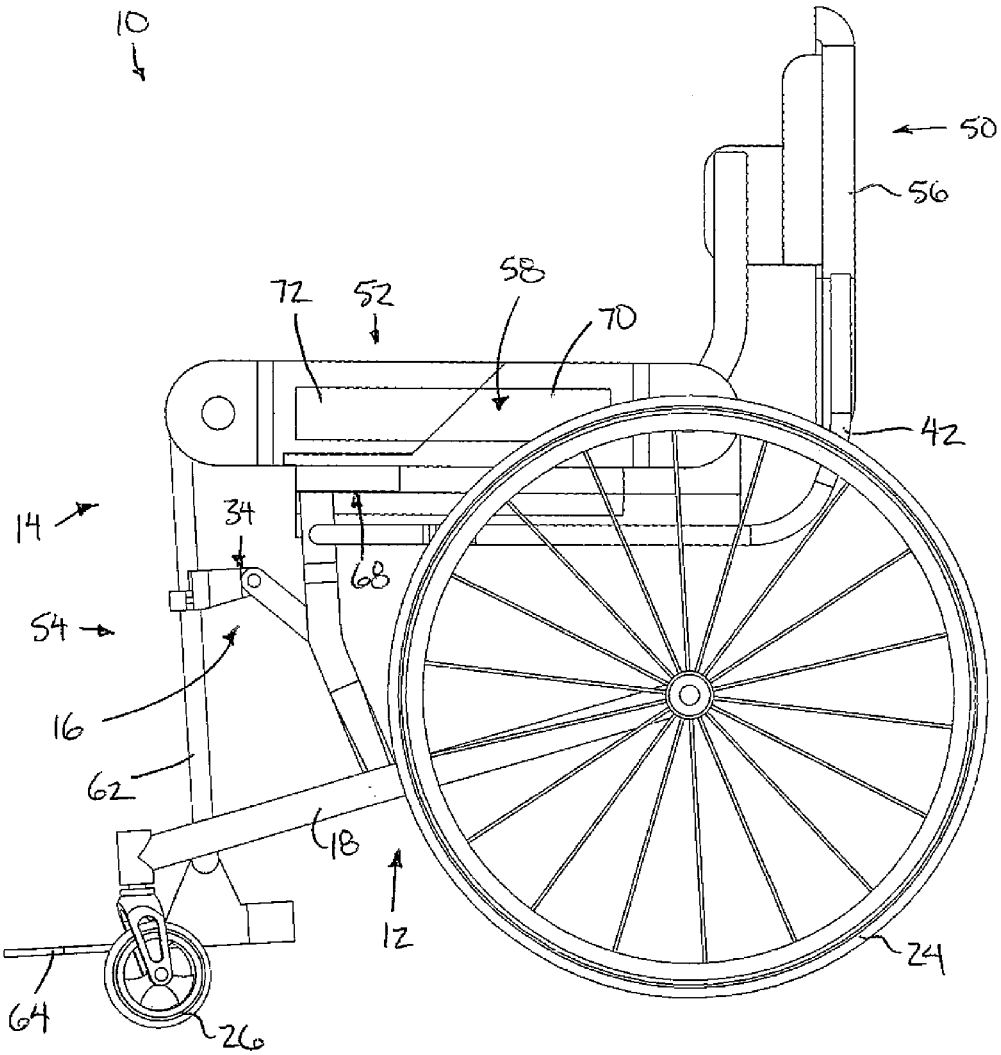
FIG. 6 is a side view of the mobility system in the sitting position.
Figure 7:
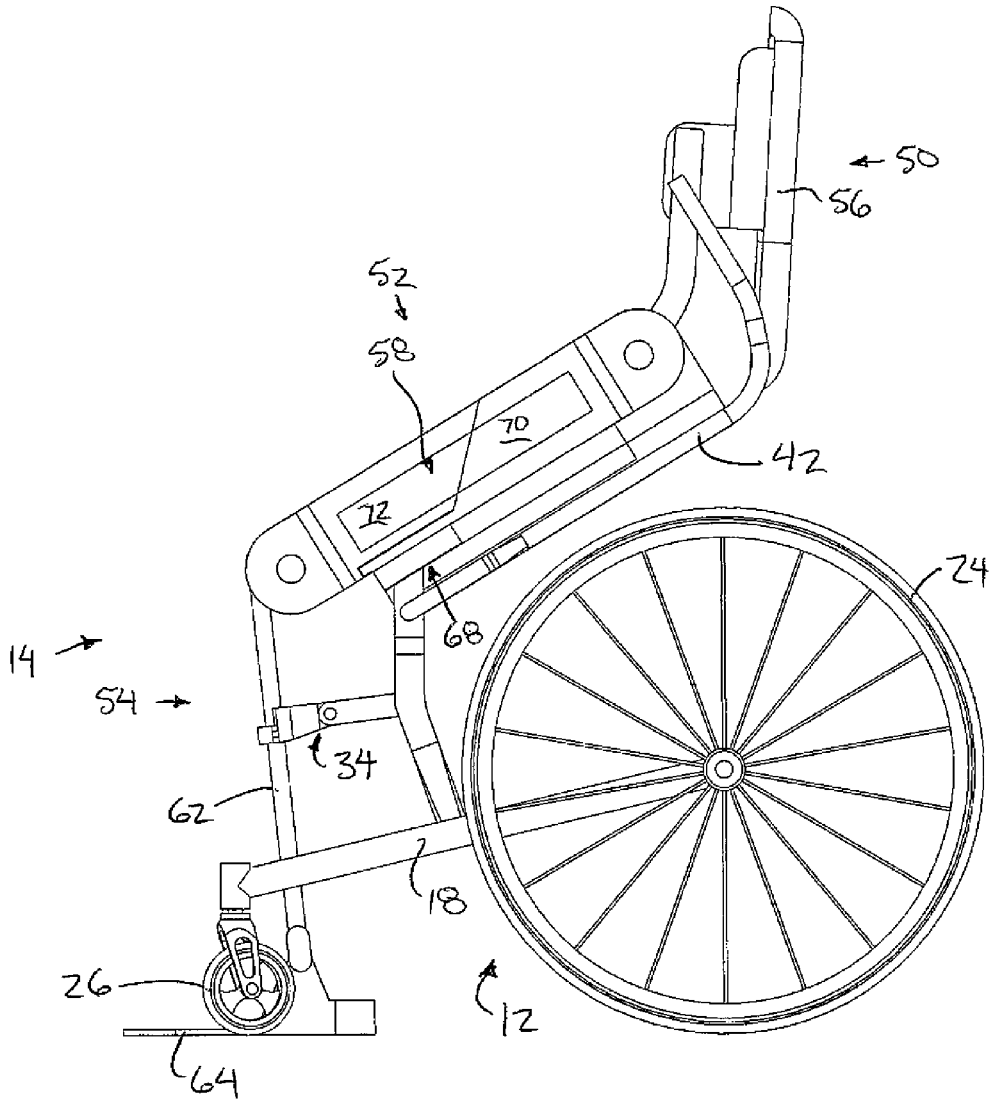
FIG. 7 is a side view of the mobility system in the intermediate position between the sitting and standing positions.
Figure 8:
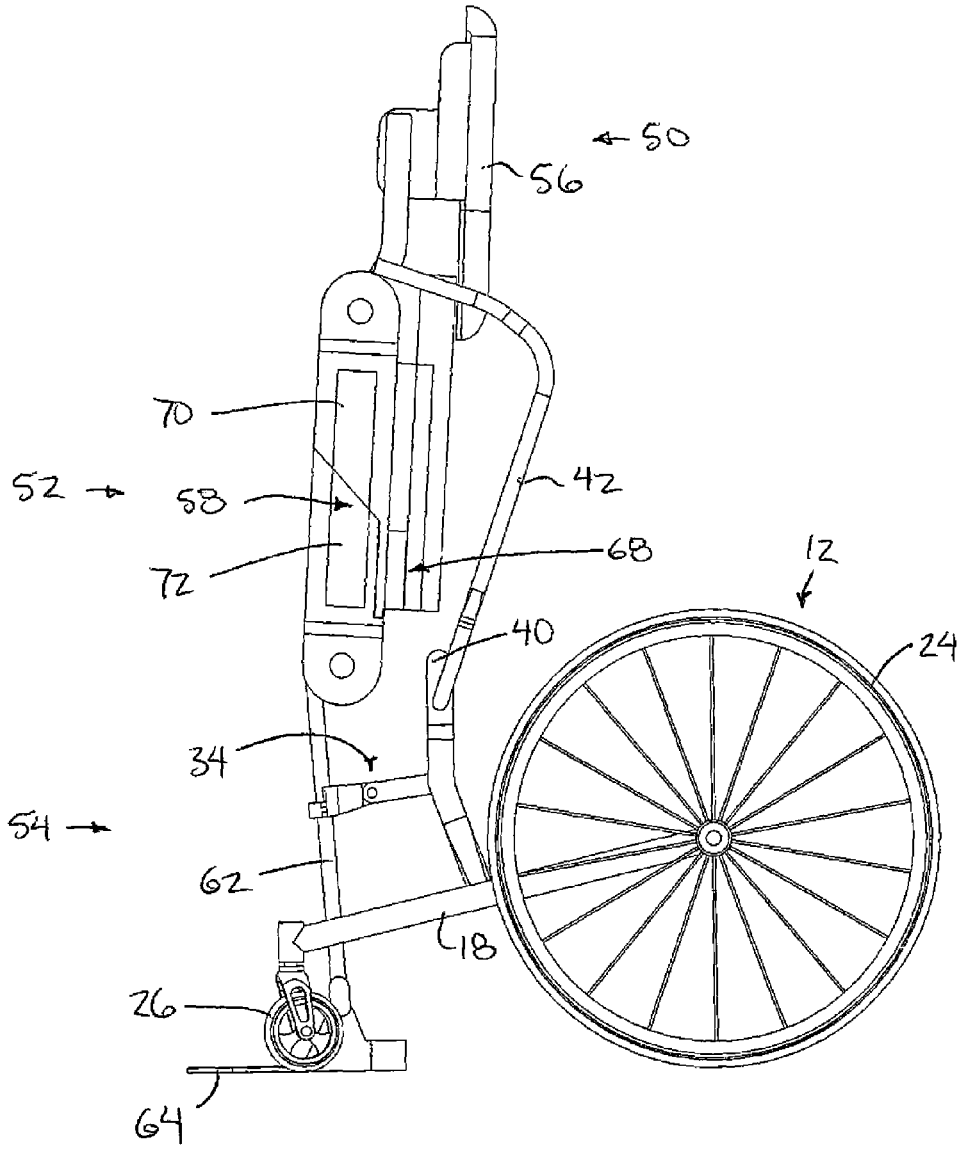
FIG. 8 is a side view of the mobility system in the standing position.
Figure 9:
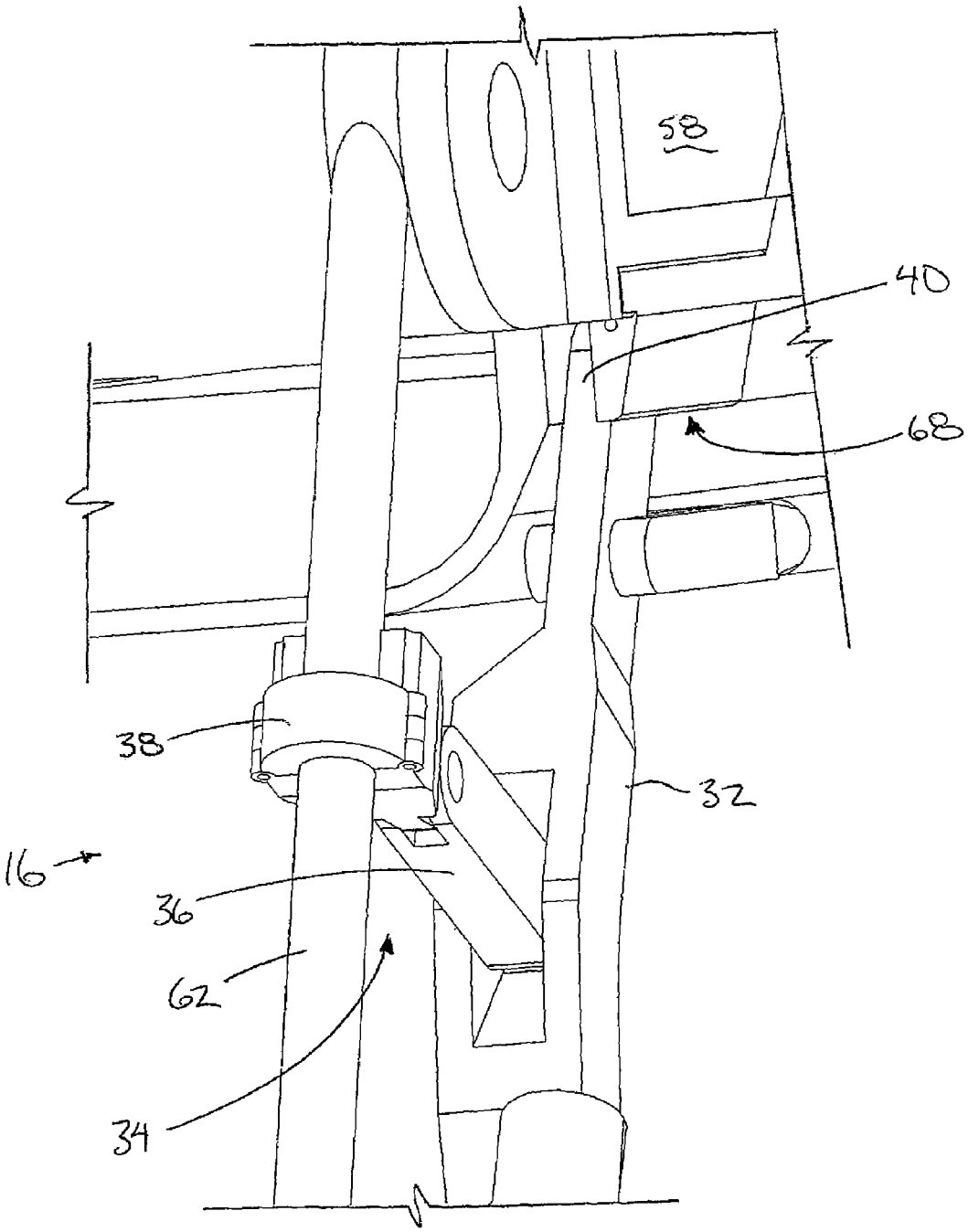
FIG. 9 is an enlarged perspective view of some components of the docking assembly.

The handle members are pivotal between a lower stored position shown in FIG. 1 and a raised working position generally shown in FIGS. 3 and 4. The handle members are biased to the raised position such that in the absence of the exoskeleton being docked to the wheeled base, the handles are oriented so that the main portion extends generally upward while the gripping portion extends generally forwardly spaced above the height of the rear wheels to be located generally at the user's hip height, corresponding to the hip joint of the exoskeleton described in further detail below. In this instance, a user standing in front of the wheeled base may grasp the gripping portions of the handle members to use the wheeled base as a walker. Alternatively, as described in further detail below, the walker handles could be detachable crutches usable for walking away from the wheeled frame after detachment of the exoskeleton. The crutches would be deployed similarly to the walker handles.

When an exoskeleton assembly is supported on the wheeled base and is lowered from the standing position to the sitting position, the handle members are positioned so as to be engaged by the exoskeleton so that the handle members are urged against the biasing by movement of the exoskeleton towards the sitting position. The handle members are thus pivoted downwardly and rearwardly from the raised position to the lowered position shown in FIG. 1 with lowering of the exoskeleton assembly. In the lower position, the main portions of the handle members extend generally rearwardly in a substantially horizontal orientation below the height of the rear wheels while the gripping portions extend upwardly from the rear ends thereof so as to be arranged to be rearward of the torso of a user seated in the exoskeleton assembly in the sitting position.

The exoskeleton assembly is configured to provide a walking function to a user when it is detached from the wheeled base. To accomplish this, the exoskeleton assembly generally includes an upper portion 50 arranged to be braced about the torso of the user, an intermediate portion 52 arranged to be braced to the thighs or upper legs of the user, and a lower portion 54 arranged to be braced to the calves or lower legs of the user. The torso of the user in this instance is understood to comprise any portion of the body which excludes the head and limbs, such that the upper portion may be braced to the user at any location along the torso from the pelvic region to the upper chest region. The bracing in each instance can be accomplished by a variety of flexible strap members, pads, contoured members, buckles or fasteners, which may be for example similar to the various types commonly used on conventional exoskeleton assemblies. A hip joint is defined between the upper portion and intermediate portion while a knee joint is defined between the intermediate portion and the lower portion.

The upper portion 50 generally comprises a rear plate member 56 which is contoured at laterally opposed side edges thereof for being received across the lower back of the user partway about the torso of the user. Additional straps and brace members are provided to permit the upper portion to be adequately secured about the torso of the user.

The intermediate portion comprises two upper leg members 58 which are independently pivotally connected to the upper portion at laterally opposed positions thereon to commonly define the hip joint of the intermediate portion relative to the upper portion. The two upper leg members are elongate rigid members arranged to extend along respective outer sides of the user's thighs with additional bracing members being provided to be secured about the legs of the user.

The pivotal connection defining the hip joints are located at the upper end of the intermediate portions along the outer sides of the legs to be spaced forwardly of a plane of the rear plate member 56 so as to be substantially aligned with the hip axis joint of the user secured within the exoskeleton assembly.

In addition to the outer portion of the upper leg member extending along the outer side of the user's leg, each upper leg member also includes a seat member 60. The two seat members of the two upper leg members are arranged to collectively define a seating surface providing the sole horizontal seating support upon which the user sits in the sitting position of the exoskeleton assembly. The two seat members are joined to the upper leg members to be movable together therewith between the sitting and standing positions relative to the wheeled base, the upper portion and the lower portion of the exoskeleton assembly. These seat members are thus removable from the wheeled base together with the exoskeleton assembly when detaching from the wheeled base.

In the sitting position, the two seat members lie in a generally horizontal sitting plane upon which the user is supported in a seating position while the longitudinal portion of each upper leg member locating the hip joint and the knee joint therein is located above the sitting plane so that the longitudinal portions extend alongside the legs of the user resting on the sitting surface.

The lower portion 54 of the exoskeleton assembly comprises two lower leg members 62 which are independently pivotally connected to respective ones of the upper leg members such that the pivotal connections collectively define the knee joint of the exoskeleton assembly. Each lower leg member is similar to the upper leg member in comprising a rigid longitudinal member arranged to extend along the outer side of the lower leg of the user and be secured thereto by suitable additional brace members or padded straps extending about the lower leg of the user just below the knees. By locating the leg member to extend along the outer side of the leg of the user, the knee joint can be aligned with the natural knee axis of the knee joint of the user.

A foot plate 64 is pivotally connected at the bottom end of each lower leg member 62 to support the foot of the user thereon when a user is secured within the exoskeleton assembly. The foot plates are pivotal relative to the lower portions 54 about respective ankle joints defined by pivot connections 66 located at the outer side of the foot of the user in alignment with an ankle axis of the user.

In this manner, the joints of the exoskeleton assembly are all aligned with the actual joints of the user while the two seat members defining the seating surface in the sitting position remain integral with the intermediate portion of the exoskeleton assembly to remain in supporting relationship along the back of the two thighs of the user respectively throughout pivotal movement of the intermediate portion relative to both upper and lower portions of the exoskeleton assembly.

Pivotal connection of the hip and knee joints in each instance of the upper leg member relative to both the upper portion and the respective lower leg members is accomplished by a respective position control motor unit mounted on the upper leg member of the intermediate portion. In this instance, each upper leg member includes a first motor adjacent the top end for controlling relative pivotal movement thereof relative to the upper portion and a second pivot control motor at the bottom end controlling relative pivotal movement thereof relative to the respective lower leg member.

The position control motor units are generally understood herein to comprise any suitable motor for actuating pivotal movement together with any gears or linkages for connection to the upper, intermediate or lower portions of the exoskeleton respectively, appropriate controllers, batteries, and other electronics and auxiliary components as may be required to produce the desired functions. The position control motor units further comprise brakes or locking members which permit the respective joint being controlled to be rigidly locked when desired. In one form, the brake may be biased into a locked condition and released only when power is applied, for example when free pivoting of the joint is desired or when the motor unit is provided with power to permit controlled pivoting under the control of the respective motor. The position control motor units may also be provided in a form which includes a motor and gear combination as used in prior art exoskeleton assemblies by Vanderbilt and Ekso, for example.

The position control motor units all provide power to actuate and accurately control the relative positions between the different components of the exoskeleton assembly throughout a walking function of the exoskeleton assembly when detached from the wheeled base. The position control motor units also provide the sole power and control for operating the exoskeleton assembly relative to the wheeled base between the sitting position and the standing position to support the exoskeleton assembly at any one of the plurality of intermediate positions therebetween as well. When supporting the exoskeleton in a selected position relative to the wheeled base, the position control motor units are operated in the locked mode in which the joints are passively locked in place without any power supplied.

In the embodiments of FIGS. 1 through 11 and 21 through 23, each lower docking member generally includes both the link member 36 and the clamp 38 pivotally connected at the forward end of the link member. In this instance, the clamps 38 remain attached to the link members 36 and are selectively attached or removed from the lower leg members 62 of the exoskeleton assembly.

Turning now to FIGS. 12 through 15, a further embodiment of the lower docking members is illustrated. In this instance, the link members 36 are again pivotally mounted on the uprights 32 as described above. However, the clamps 38 are instead attached to the lower leg members 62 respectively. The clamps in this instance may be powered by the power supply available on the exoskeleton assembly to be operated between a clamped position shown in FIG. 13 and a released position shown in FIGS. 14 and 15. The clamp includes two opposed clamping members 100 which are movable relative to one another by relative pivotal movement about an upright longitudinal axis of the lower leg member 62 between the released position spaced apart from one another and the clamped position in which the clamping members are nearer to one another than the released position for clamping the forward end of the respective link member 36 therebetween. Each clamping member 100 locates a respective pivot shaft 102 on an inner face thereof so that the pivot shafts are received into opposing ends of a corresponding bore in the forward end of the link member in the clamped position to define a horizontal axis of relative pivotal movement therebetween. During operation of the exoskeleton assembly between different positions relative to the wheeled base, the clamps sufficiently clamp the link members therein to align the pivot shafts with the bores to allow relative pivotal movement. Once a desired position of the exoskeleton meeting has been reached, the clamping force can be increased to fully lock the pivotal connection between the link members and clamps and fix the relative position therebetween.

Figure 23:
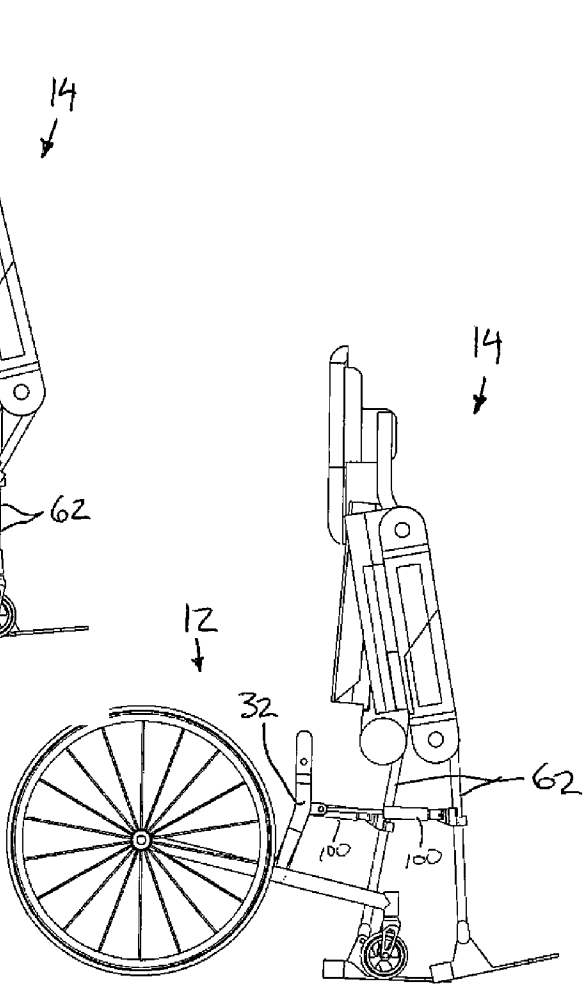
FIGS. 21, 22, and 23 are side views of the mobility system according to an alternative embodiment of the docking assembly which incorporates extensible links such that the wheeled base can remain connected to the lower portion of the exoskeleton assembly throughout a range of different positions of the exoskeleton assembly shown in the figures during a walking motion.
Figure 22:
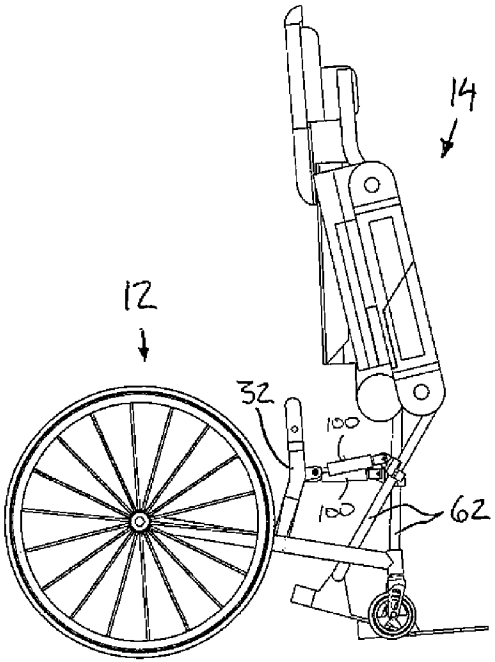
Figure 21:
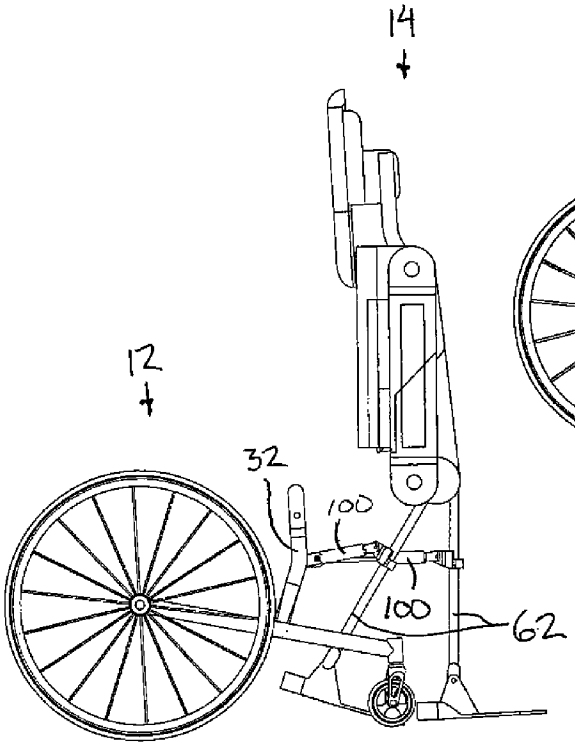

Turning now to the embodiment of FIGS. 21 through 23, the link member 36 of each lower docking member is an extensible link 100 which is extendible in length while in the coupled position of the docking assembly. In this instance, an overall length between the pivotal connection to the exoskeleton assembly and the pivotal connection to the wheeled base is extendible independently of the other link. In a preferred embodiment, each extensible link is a powered linear actuator which is robotically controlled to coordinate the extension and retraction thereof with a walking movement of the exoskeleton. In this manner the wheeled base can remain attached to the exoskeleton by the docking connection to the lower leg members only for trailing the exoskeleton during walking. The wheeled base can provide stability and balance to the exoskeleton such that the user may not require the additional use of crutches during walking movement with the exoskeleton.

In a further arrangement, the extensible links may each be a passively extendible member which is freely slidable between extended and retracted positions such that the wheeled base remains in a trailing configuration relative to the walking exoskeleton, but all extension and retraction is dictated solely by the walking movement of the exoskeleton.

Docking of the exoskeleton assembly relative to the wheeled base is accomplished in the first embodiment of the lower docking members by initially engaging a first one of the clamps 38 of the lower docking members to a respective one of the lower leg members of the exoskeleton assembly. Each lower leg member is arranged such that the clamp permits relative pivotal movement about a vertical axis between the exoskeleton assembly and the wheeled base when the other clamp remains released. This permits ease of alignment of the second clamp 38 with the other lower leg member once one clamp has been engaged into a coupled position.

In the second embodiment of the lower docking members, the clamps on the exoskeleton can be actuated to clamp onto the link members on the wheeled base to initially allow relative pivotal movement therebetween. Each clamp on the exoskeleton can similarly provide relative pivotal movement between the wheeled base and the exoskeleton about a generally vertical axis when the other clamp is released.

In all of the illustrated embodiments of FIGS. 1 through 23, the coupling of the two lower leg members is typically accomplished while the exoskeleton assembly remains in a standing position. In the standing position of the exoskeleton assembly relative to the wheeled base, the docking assembly provides connection only by the engagement of the lower docking members on the wheeled base with the lower leg members of the lower portion of the exoskeleton assembly. The connection of the lower docking members remains coupled and engaged throughout the pivotal movement of the exoskeleton assembly between sitting and standing positions.

The upper docking members are arranged to engage the upper leg members of the intermediate portion of the exoskeleton assembly at one of the intermediate positions partway between the sitting and standing positions. The foot plates remain engaged with the ground until the upper docking members become engaged with the exoskeleton assembly.

More particularly, each upper leg member is provided with a pocket 68 in the rear of the upper leg member in the standing position which is arranged to automatically align with and receive the top end of the respective upright 32 defining the upper docking member therein as the exoskeleton assembly is lowered from the standing position to the sitting position. The pocket 68 is located at an intermediate position in the longitudinal direction of the upper leg member to be spaced from the knee joint partway between the knee and hip joints. The upper ends of the two uprights defining the two upper docking members define fulcrums received within the pocket 68 to define a pivotal engagement about which the upper leg members are pivoted relative to the wheeled base as the exoskeleton assembly is displaced from the intermediate position corresponding to engagement upper docking members to the sitting position.

The pivotal engagement of the upper docking members defines one pivot of a four bar linkage defining a passive linkage which automatically causes the lower leg members to be lifted off of the ground upon which the wheels of the base are supported automatically with pivotal displacement of the exoskeleton assembly from the standing position to the sitting position. The four links of the defined four bar linkage include i) a portion of the uprights 32 between the pivotal connection of the lower docking members and the pivotal engagement at the top end defining the upper docking members, ii) the link members of the lower docking members, iii) a portion of the lower leg members between the clamping connection of the clamps and the knee joint, and iv) the portion of the upper leg member from the knee joint to the pivotal engagement with the upper docking members. In this instance, pivoting of the upper leg members about the pivot engagement of the upper docking members from standing to sifting causes the forward ends of the lower leg members at the knee joint to be raised upwardly which in turn lifts the lower leg members suspended therefrom together with the foot plate at the bottom ends thereof to lift the feet of the user off of the ground in the sitting position.

Once the exoskeleton is in the desired sitting position, the clamps of the lower docking members, the clamping portions of the pockets receiving the upper docking members, and the position control motor units are all locked and fixed in position to be restricted from further relative movement until a position change is desired, without any power being required.

To assist transferring a user into and out of the exoskeleton assembly in the sitting position, each upper leg member of the intermediate portion includes a main portion 70 which remains fixed to the respective seat member defining the sitting surface for supporting the user thereon and a movable access portion 72. The main portion also remains in fixed relation to the hip joint connection to the upper torso portion and remains engaged with the upper docking member in the sitting position. The access portion 72 includes a forward end of the upper leg member above the seating surface of the seat member, the knee joint and position control motor unit associated therewith, and an upper portion of the lower leg member connected by the knee joint. The access portion 72 is moveable from a normal working position permitting the position of the exoskeleton assembly to be controlled and an access position in which lateral transfer access of a user into and out of the seating surface area is increased.

More particularly, in the normal working position with the exoskeleton assembly in the sitting position, the access portion 72 of the upper leg member remains positioned along the outer side of the leg and knee of the user to be located spaced above the forward end of the seat with the knee joint aligned with the knee of a user seated within the exoskeleton assembly.

Figure 10:
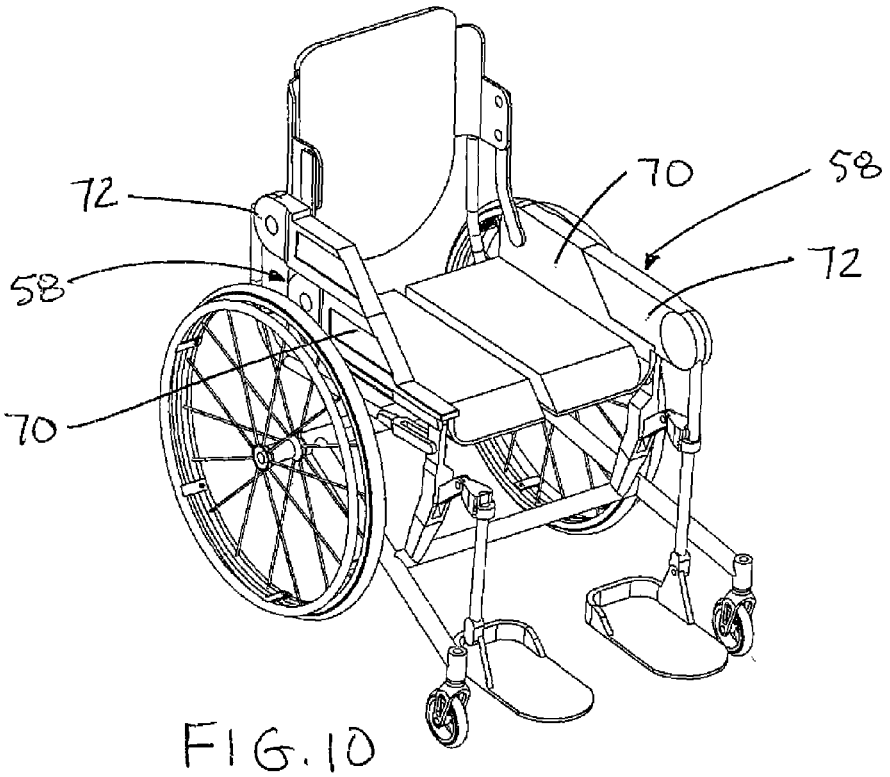
FIG. 10 is a perspective view of a first embodiment of the access portion of the exoskeleton assembly in an access position.
Figure 11:
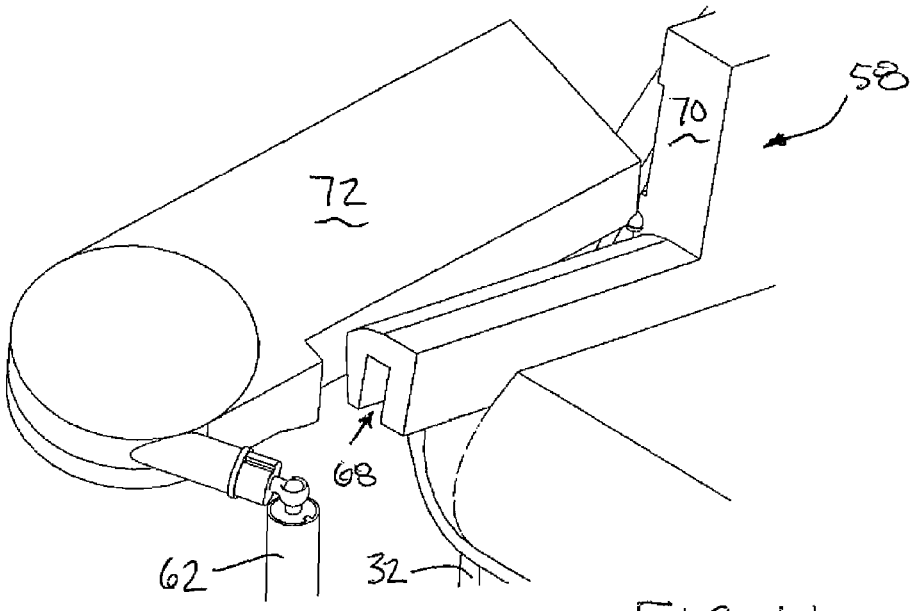
FIG. 11 is a perspective view of an alternative embodiment of the access portion of the exoskeleton assembly.
Figure 12:
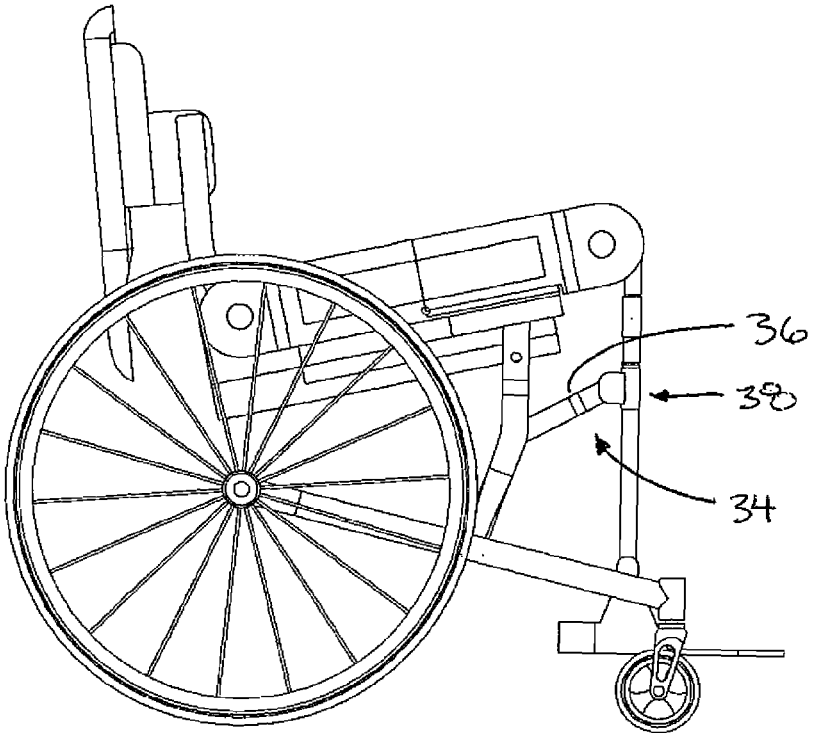
FIG. 12 is a side elevational view of the mobility system in the sitting position according to a second embodiment of the lower docking members.
Figure 13:
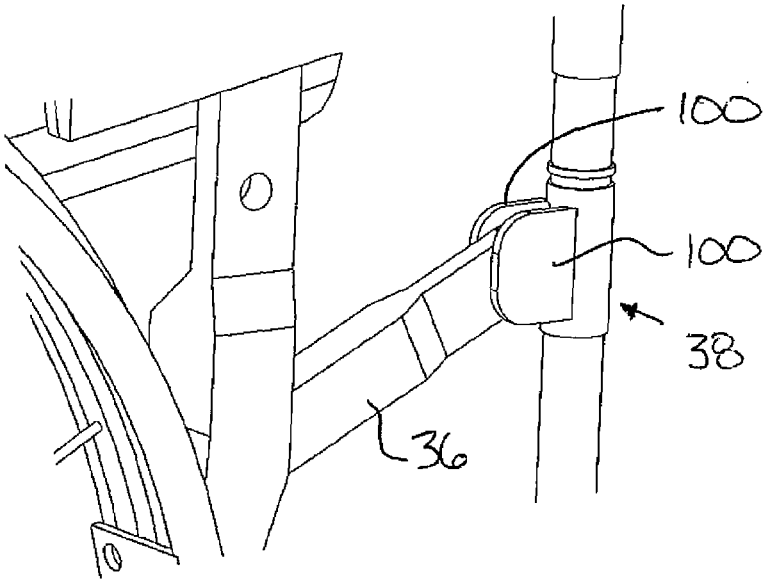
FIG. 13 is a perspective view of one of the lower docking members according to FIG. 12 in a clamped position.
Figure 14:
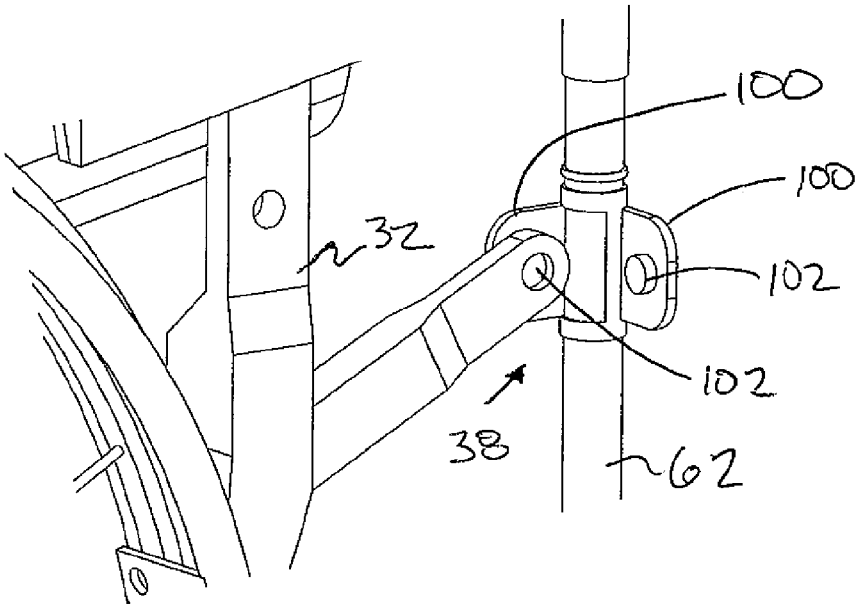
FIG. 14 is a perspective view of one of the lower docking members according to FIG. 12 in a partially released position.
Figure 15:
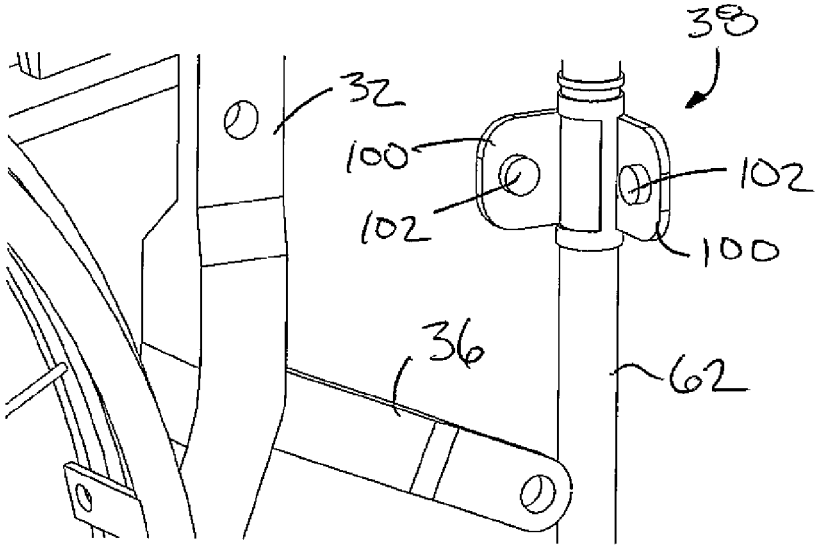
FIG. 15 is a perspective view of one of the lower docking members according to FIG. 12 in a fully released position.

The access portion is movable from the working position to the access position by folding upwardly and rearwardly over top of the main portion according to the embodiment of FIGS. 1 through 10 or by pivoting laterally outwardly and downwardly into the access position according to the embodiment of FIG. 11.

In the embodiment of FIG. 10, the upper portion of the lower leg member included within the access portion is disconnected from the remaining lower leg portion and the access portion is hinged between working and access positions by a hinge axis between the access portion and the main portion of the upper leg member.

Alternatively in the embodiment of FIG. 11, the upper portion of the lower leg member remains pivotally connected to the lower portion thereof by a first pivot connection while the access portion of the upper leg member is pivoted to the remaining main portion of the upper leg member. Regardless of the angular position of the knee joint, all components of the access portion are effectively pivoted between the working and access position about a single prescribed axis associated with the respective angular position of the knee joint in which the prescribed axis extends between the two pivot connections. In either instance, in the access position, the resulting area above the seating surface at the forward end thereof is substantially unobstructed in the lateral direction towards the outer side of the thigh and the knee of the user for ease of laterally transferring a user into and out of the seat area in the sitting position of the exoskeleton assembly.

Figure 20:
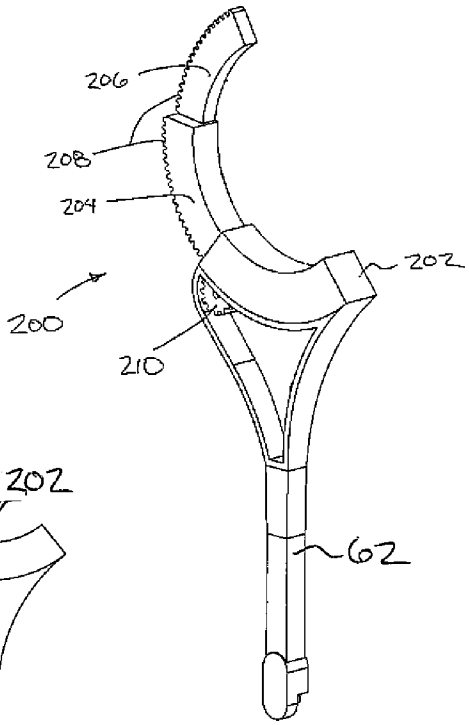
FIG. 20 is a perspective view of the linkage of the knee joint according to FIG. 18 in the extended position.
Figure 19:
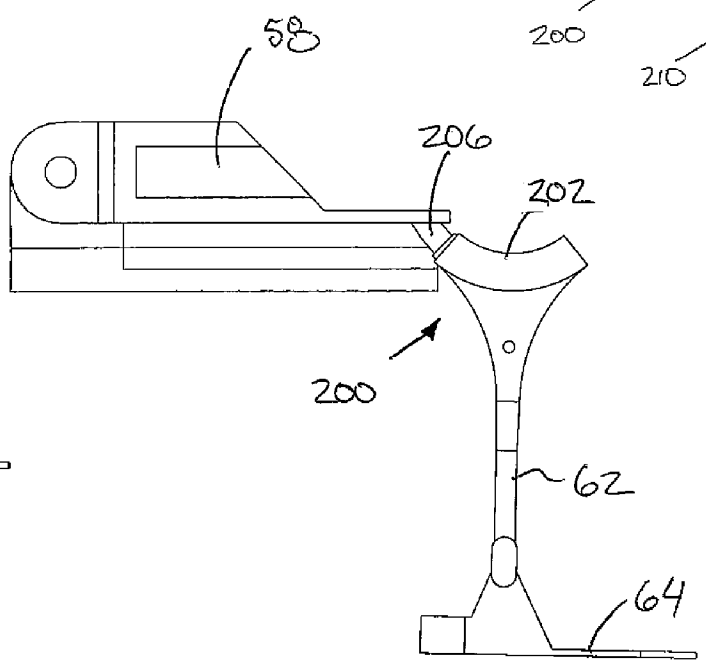
FIG. 19 is a side view of the knee joint according to FIG. 18 in the sitting position.
Figure 18:
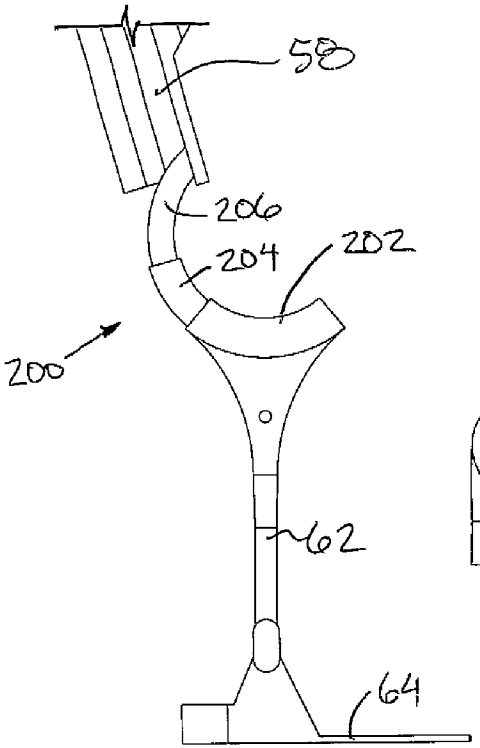
FIG. 18 is a side view of an alternative embodiment of the knee joint of the exoskeleton assembly in an extended position in proximity to the standing position.

Turning now to the embodiment of FIGS. 18 through 20, the exoskeleton assembly may not require a movable access portion 72 as described above by instead arranging the knee joints to remain open and unobstructed at the pivot axis between the upper and lower leg members. More particularly, when the intermediate portion of the exoskeleton comprises two upper leg members and the lower portion comprises two lower leg members independently connected to respective ones of the upper leg members by respective pivot connections of the knee joint, each pivot connection may comprise a linkage 200 instead of pinned joint. The linkage 200 is arranged to still define a respective pivot axis of the relative movement between the respective lower leg member and the respective upper leg member from the sitting position to the standing position of the exoskeleton; however, the linkage which is open at the pivot axis, at least in the sitting position, such that the knee joint is unobstructed by the linkage at the pivot axis, at least in the sitting position.

In the illustrated embodiment of FIG. 18 through 20, each linkage 200 includes a lower arcuate member 202 fixed to the lower leg member, an intermediate arcuate member 204 which is telescopically connected to the lower arcuate member, and an upper arcuate member 206 which is telescopically connected to the intermediate arcuate member and is fixed to the upper leg member. Each of the arcuate members is an arc shaped member which has a center of radius coinciding with the pivot axis of the pivot connection. The arcuate members are slidable relative to one another in a circumferential direction relative to the pivot axis so that as the collective arcuate members are telescopically extended and retracted relative to one another in the circumferential direction, the upper leg member is pivoted relative to the lower leg member about the pivot axis of the pivot connection.

In the illustrated embodiment, both the upper and intermediate arcuate members define respective portions of an arcuate shaped path of movement of the lower arcuate member therealong. Both the upper and intermediate arcuate members may further comprise respective portions of a rack of gear teeth 208 therealong which is engaged by a pinion gear 210 rotatably supported on the lower leg member with the lower arcuate member. The lower arcuate member and the pinion gear in this instance collectively define a follower which follows along the arcuate path defined by the upper and intermediate arcuate members as the pinion gear is driven to rotate while meshing with the rack of gear teeth. A powered control is coupled to the pinion gear to control the position and rotation thereof which in turn controls the angular position of the upper leg member relative to the lower leg member as well as powering the standing, walking, and seating actions of the exoskeleton as the lower leg member is folded and extended relative to the upper leg member.

Figure 17:
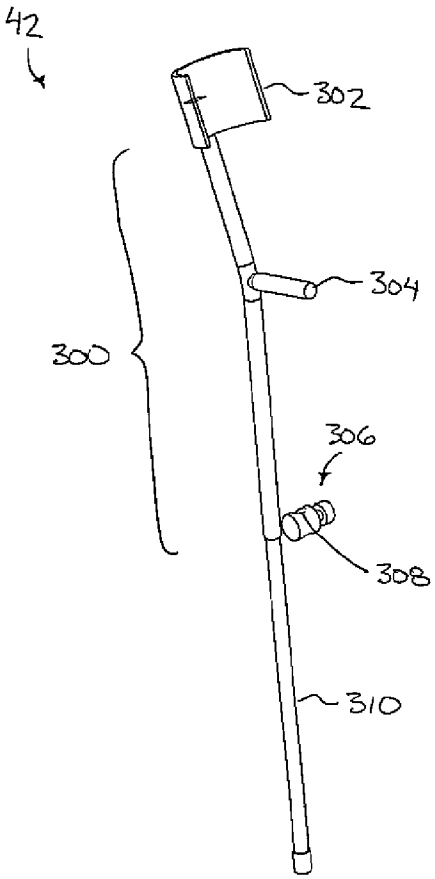
FIG. 17 is a perspective view of one of the handles according to FIG. 16 separated from the wheeled base in a working condition as a crutch.
Figure 16:
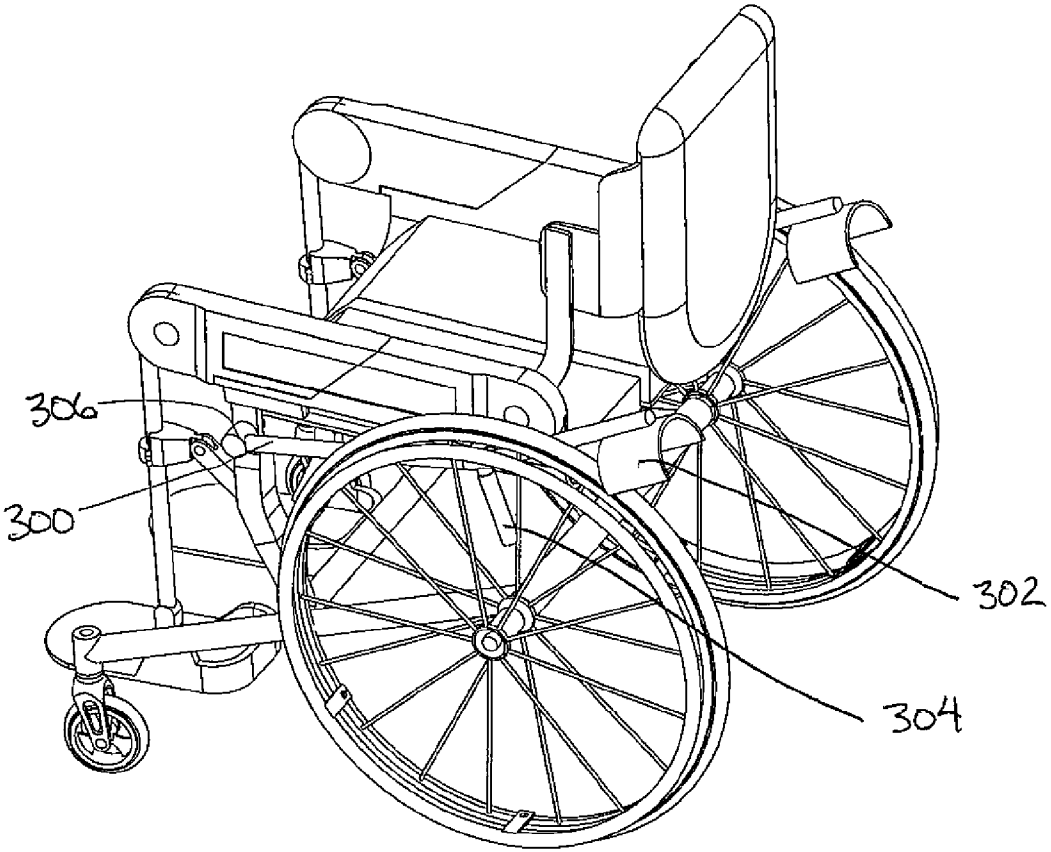
FIG. 16 is a perspective view of the mobility system in a sitting position according to a second embodiment of the handles in a docked condition.

According to yet another embodiment of the present invention as shown in FIGS. 16 and 17, the system may be substantially identical to either of the previous embodiments with the exception of the handles 42. In this instance each handle is selectively separable from the wheeled base so as to be functional as a stand-alone crutch when separated from the wheeled base.

In the illustrated embodiment, each handle comprises an elongate upper shaft portion 300 supporting a forearm brace portion 302 at a top end which is cup shaped for gripping about a forearm of a user, and a gripping portion 304 at an intermediate location thereon which is suitable for gripping in a hand of a user at a location spaced longitudinally below the brace portion. A pivot assembly 306 is mounted on the respective side of the wheeled base which includes a socket 308 arranged to selectively mount the bottom end of the upper shaft portion 300 therein. The pivot assembly includes the biasing elements therein which bias the handles 42 upwardly from the sitting position to the standing position of the exoskeleton as described above. A lower shaft portion 310 is arranged to be telescopically received within the upper shaft portion 300 such that an overall length of the handle can be adjusted by telescopically extending the lower shaft portion from the upper shaft portion. Typically the lower shaft portion is retracted relative to the upper shaft portion to minimize the overall length of the handle in a docked condition coupled to the wheeled base. When separating the handles from the wheeled base, the handles are extended in length from the docked condition to a working condition so as to be of suitable overall length for use as a stand-alone crutch separated from the wheeled base.

In use, a user is most easily transferred into the exoskeleton assembly by initially positioning the exoskeleton assembly in the sitting position on the wheeled base and using the additional access provided by the access portion. Once the user is seated on the seat members, the various portions of the exoskeleton assembly are braced about the torso, thighs and lower legs of the user. The position control motor units of the exoskeleton assembly can then be used to vary the position of the user between the sitting position, various intermediate positions and the standing position. The backrest can be independently reclined as well if so desired. At each of the intermediate positions, the seat members of the upper leg members generally extend at an upward inclination from the knee joint to the hip joint while the upper portion and the lower leg portion remain generally upright for supporting the upper body of the user at various elevations depending upon desired tasks.

The handle members are engaged by the exoskeleton assembly such that the exoskeleton assembly acts to retain the handle members in the lowered position when the exoskeleton is seated with the gripping portions being located behind the user in alignment with the rear plate of the torso portion. As the exoskeleton assembly is raised towards the standing position, the biasing of the handle members causes the handle members to remain engaged with the underside of the exoskeleton assembly and be similarly raised towards their respective raised position.

The pockets 68 of the exoskeleton assembly can be provided with a clamping function as noted above for fixedly securing the upper leg members relative to the upper docking members in the sitting position. However, throughout the upward pivoting movement of the upper leg members relative to the wheeled base towards the standing position, the pockets permit free pivotal movement between the wheeled base and the exoskeleton assembly. The clamps of the lower docking members are similarly arranged to provide free pivotal movement as the position of the exoskeleton assembly is varied.

Once the foot plates engage the ground as the exoskeleton assembly is pivoted towards the standing position, continued pivoting of the exoskeleton assembly towards the standing position causes the pockets 68 to be lifted up off of the top ends of the uprights 32 defining the upper docking members to automatically disengage the upper docking members while the lower docking members remain engaged throughout the remainder of the pivoting movement of the exoskeleton assembly towards the standing position.

Once in the standing position, the clamps of the lower docking members can be readily disengaged and the user can then assume the walking function of the exoskeleton assembly separate from the wheeled base.

The reverse order of events permits the exoskeleton assembly to be again reconnected onto the wheeled base and lowered from the standing position to various sitting positions.

As described above, a powered walking exoskeleton concept similar to the ReWalk, Ekso, and Vanderbilt designs is described herein. The mobility system and exoskeleton concept is referred to generally herein as COMBO and it includes additional mechanical features to facilitate docking to a wheeled frame and to support sitting. In the standing position, the exoskeleton is mated to the wheeled frame at each shank (i.e. lower leg) section via clamping mechanisms distal to left and right front frame linkages. Either left or right shank attachment is independently clampable and rotatable to the frame. This enables a user to align the frame with the exoskeleton at only one point, thus promoting ease of attachment. Following mating at a single side, the frame can be rotated about a shank until the other side mates and clamps together. Once in this position, COMBO is analogous to a standing wheelchair, with a footplate firmly in contact with the floor to promote stability and safety. A user can then use the exoskeleton actuators in the knee and hip joints to lower into any seating position. Five key design elements facilitate the transformation of COMBO from exoskeleton into a manual wheelchair with dynamic seating.

A first key to our design concept is a passive dynamic wheelchair positioning capability. As the exoskeleton lowers, the thigh sections make contact with another part of the wheeled frame (denoted as "upper bars" of the frame), causing the front linkages to pivot and raise the feet off the ground. At a predetermined seat angle, the feet are raised in this fashion and COMBO can be manoeuvred in a manner analogous to a manual wheelchair. This positioning process is completely passive in relationship to the wheeled frame. Thus, no power to the frame is necessary, and a simple inexpensive wheeled frame design is realized.

A second key to our design concept is transfer access—incorporating liftable thigh sections that facilitate transfers to and from the device. Wheelchair transfers in general are one of the highest-scored essential wheeled mobility skills for daily life. Currently most exoskeletons involve difficult transfers in and out due to the requirement of accurate alignment of knee and hip joints between the device and the user to promote a desirable walking pattern and minimize shear on the legs and back. Two exoskeleton designs address this issue: Ekso has a hinged thigh section which allows the leg components to swing away and Vanderbilt is built in three components attachable around a seated user.

COMBO overcomes this challenge through exoskeleton thigh sections which will be split into two sections, with internal motor and gears separated between the knee actuators and hip actuators. The front section, including knee joint and portion of the shank, is liftable, for manual rotation towards the rear of the wheeled frame, and stowed. This results in an open area similar to existing manual wheelchairs, thus facilitating transfers to and from the device. Much of the design innovation (and related weight, expense, and difficulty) around standing wheelchairs relates to minimizing shear as the user changes position. An exoskeleton design does this inherently and naturally through close alignment of device and user at the hip and knee. As a dynamic "standing wheelchair", COMBO makes use of the exoskeleton alignment to minimize shear on the legs, seat and back, while employing a movable access portion in the intermediate section of the exoskeleton assembly to overcome the transfer obstacles this alignment creates.

The third key to our design concept is greater frame rigidity. Due to the potential flexible geometry of "hanging" the exoskeleton off the front of the wheeled frame, it is desired to include structure to support and stiffen COMBO when attached. This is achieved through activated thigh-section channels and upper bars of the wheelchair frame. A channel dorsal to each exoskeleton thigh section is designed so that, as the exoskeleton lowers from the standing position, the upper bars of the wheelchair frame mate into each channel. When the exoskeleton stops moving, the channels are pinched together to grasp the upper bars of the frame. Our aim with this design is to create rigidity which will enable more of the push force to be translated into movement when COMBO is used as a manual wheelchair. Furthermore, when a front thigh section is lifted away (for transfers), a link between the shank and thigh is still intact to maintain frame stiffness (and thus push efficiency) even in absence of the knee joint.

The fourth key is passive deployable handles. As COMBO moves from sitting to standing, handles are passively raised via biased springs (which force the handles to an upright vertical position). When fully upright, the handles lock into position, transforming the wheeled frame into a walker.

The fifth key is integrated seating. The design of the exoskeleton thigh sections will incorporate a molded orthotic-like seat structure that wraps under the thigh and buttocks of the user. When the user is seated, each thigh section is aligned together such that a seat analogous to modern wheelchair cushions is formed. This design will support wheelchair transfers and long-term sitting. These five key elements together generate many potential functional benefits.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A mobility system for providing mobility assistance to a user, the system comprising a wheeled base, an exoskeleton assembly, and a docking assembly arranged to selectively support the exoskeleton assembly on the wheeled base, the wheeled base comprising a base frame and wheels supporting the base frame for rolling movement along the ground and the exoskeleton assembly comprising:

an upper portion arranged to be braced to a torso of a user;

an intermediate portion comprising two upper leg members independently pivotally connected to the upper portion and arranged to be braced to respective thighs of the user;

a hip joint pivotally coupling the intermediate portion to the upper portion;

a lower portion comprising two independent lower leg members arranged to be braced to respective lower legs of user; and a knee joint comprising two pivot connections pivotally coupling the lower leg members of the lower portion to the upper leg members of the intermediate portion respectively;

whereby the exoskeleton assembly is configured to provide a walking motion to the user;

the docking assembly being operable between a coupled position in which the exoskeleton assembly is coupled to the wheeled base and the exoskeleton assembly is movable relative to the wheeled base between respective standing and sitting positions and a released position in which the exoskeleton assembly is readily separable from the wheeled base in the standing position of the exoskeleton assembly; and the docking assembly being arranged to support the exoskeleton assembly thereon for normal use as a wheelchair on the wheeled base through a range of intermediate positions between the sitting position and the standing position in which the intermediate portion extends at a respective upward inclination from the lower portion to the upper portion in each of the intermediate positions.

2. The system according to claim 1 wherein the exoskeleton assembly further comprises a position control motor unit associated with each of the hip and knee joints which is separable from the wheeled base together with the exoskeleton assembly, the exoskeleton assembly being movable relative to the wheeled base between the standing position and the sitting position in the coupled position of the docking assembly solely under control of the position control motor units.

3. The system according to claim 1 wherein the docking assembly includes a pair of lower docking members arranged to be coupled to respective ones of the two lower leg members independently of one another, at least one of the lower docking members providing relative pivotal movement between the exoskeleton assembly and the wheeled base about a vertical axis when the other lower docking member is released.

4. The system according to claim 1 wherein the docking assembly is arranged to be engaged between the wheeled base and each of the lower portion and the intermediate portion of the exoskeleton assembly in the sitting position.

5. The system according to claim 1 wherein the docking assembly includes at least one lower docking member which is pivotally coupled between the lower portion of the exoskeleton assembly and the wheeled base throughout movement of the exoskeleton assembly between the sitting position and the standing position and at least one upper docking member which is engaged between the intermediate portion of the exoskeleton assembly and the wheeled base in the sitting position, said at least one upper docking member being arranged to be releasable as the exoskeleton assembly is displaced towards the standing position, whereby in the standing position the docking assembly is only engaged by said at least one lower docking member between the wheeled base and the lower portion of the exoskeleton assembly.

6. The system according to claim 1 wherein the docking assembly includes at least one lower docking member which is pivotally coupled between the lower portion of the exoskeleton assembly and the wheeled base throughout movement of the exoskeleton assembly between the standing position and the sitting position, said at least one lower docking member comprises a linkage arranged to passively raise the lower portion of the exoskeleton assembly relative to the wheeled base as the exoskeleton assembly is displaced towards the sitting position.

7. The system according to claim 6 wherein the docking assembly further comprises at least one upper docking member which is arranged to engage the intermediate portion of the exoskeleton assembly such that the intermediate portion is generally pivotally supported relative to the wheeled base at a location on the intermediate portion spaced from the knee joint between the knee joint and the hip joint as the exoskeleton assembly approaches the sitting position, and wherein said at least one lower docking member comprises a link member which is pivotally coupled to the wheeled base at a first end and extends generally forwardly to a second end pivotally coupled to the lower portion of the exoskeleton assembly.

8. The system according to claim 1 further comprising a seating surface arranged to support the user seated thereon in the sitting position of the exoskeleton assembly, the seating surface being supported on the intermediate portion so as to be pivotal together with the intermediate portion relative to the upper portion about a hip axis of the hip joint and so as to be pivotal together with the intermediate portion relative to the lower portion about a knee axis of the knee joint, the hip joint of the exoskeleton assembly being arranged to align the hip axis with a hip joint of the user and the knee joint of the exoskeleton assembly being arranged to align the knee axis with a knee joint of the user.

9. The system according to claim 1 wherein:

a pair of seat members are supported on the two upper leg members respectively so as to be arranged to support respective thighs of the user thereon in the seated position; and at least one of the upper leg members includes an access portion which is movable between a working position in which the access portion extends above the respective seat member adjacent of forward end of the seat member in the sifting position so as to be arranged to extend alongside an outer side of the thigh of the user in the sitting position and an access position in which the access portion is spaced from the working position such that the respective seat member is substantially laterally unobstructed adjacent the forward end.

10. The system according to claim 9 wherein the access portion of said at least one upper leg member includes the respective pivot connection of the knee joint and a portion of the respective lower leg member which are movable together therewith between the working position and the access position.

11. The system according to claim 1 wherein the base frame of the wheeled base includes a lower frame portion supported on the wheels and a pair of handles movable relative to the lower frame portion between a raised position in which the handles are near in elevational to the hip joint of the exoskeleton assembly in the standing position and a lowered position in which the handles are lower in elevation than the raised position.

12. The system according to claim 11 wherein the handles are biased towards the raised position and wherein the exoskeleton assembly is arranged to engage the handles as the exoskeleton assembly is displaced between the standing position and the sitting position such that the exoskeleton assembly is arranged to lower the handles into the lowered position as the exoskeleton assembly is displaced towards the sitting position.

13. The system according to claim 11 wherein each handle is selectively separable from the wheeled base and includes a brace portion and a gripping portion longitudinally spaced apart from one another so as to be functional as a stand-alone crutch when separated from the wheeled base.

14. The system according to claim 13 wherein each handle is extendible in length from a docked condition arranged to be supported on the wheeled base to a working position arranged to function as a stand-alone crutch separated from the wheeled base.

15. The system according to claim 1 wherein the docking assembly further comprises:

at least one lower docking member coupled between the wheeled base and the exoskeleton assembly throughout movement of the exoskeleton assembly between the standing position and the sitting position; and at least one upper docking member comprising a pivotal connection between the intermediate portion of the exoskeleton assembly and the wheeled base throughout movement of the exoskeleton assembly between the intermediate positions and the sitting position.

16. The system according to claim 1 further comprising:

a position control motor associated with the knee joint such that the intermediate portion of the exoskeleton assembly pivots relative to the lower portion of the exoskeleton assembly solely under control of the position control motor unit;

the docking assembly comprising at least one lower docking member comprising a link member extending between a first end pivotally coupled at a fixed pivot location on the wheeled base and a second end pivotally coupled at a fixed pivot location on the lower portion of the exoskeleton assembly throughout movement of the exoskeleton assembly between the standing position and the sitting position; and at least one upper docking member comprising a pivotal connection between the intermediate portion of the exoskeleton assembly and the wheeled base at a pivot location which is fixed relative to the intermediate portion of the exoskeleton assembly throughout movement of the exoskeleton assembly between the intermediate positions and the sitting position.

17. A mobility system for providing mobility assistance to a user, the system comprising a wheeled base, an exoskeleton assembly, and a docking assembly arranged to selectively support the exoskeleton assembly on the wheeled base, the wheeled base comprising a base frame and wheels supporting the base frame for rolling movement along the ground and the exoskeleton assembly comprising:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user;

a knee joint pivotally coupling the lower portion to the intermediate portion;

whereby the exoskeleton assembly is configured to provide a walking, motion to the user;

the docking assembly being operable between a coupled position in which the exoskeleton assembly is coupled to the wheeled base and the exoskeleton assembly is movable relative to the wheeled base between respective standing and sitting positions and a released position in which the exoskeleton assembly is readily separable from the wheeled base in the standing position of the exoskeleton assembly; and a seating surface providing sole sifting support to the user seated thereon in the sitting position of the exoskeleton assembly, the seating surface being supported on the intermediate portion of the exoskeleton assembly for separation from the wheeled base together with the exoskeleton assembly in the released position of the docking assembly, the seating surface being adapted to move with the intermediate portion of the exoskeleton assembly when the exoskeleton assembly provides said walking motion to the user.

18. The system according to claim 17 wherein the intermediate portion comprises two upper leg members independently pivotally connected to the upper portion and wherein the seating surface comprises a pair of seat members supported on the two upper leg members respectively so as to be arranged to support respective thighs of the user thereon in the sitting position.

19. A mobility system for providing mobility assistance to a user, the system comprising a wheeled base, an exoskeleton assembly, and a docking assembly arranged to support the exoskeleton assembly on the wheeled base such that the exoskeleton assembly is movable relative to the wheeled base between respective standing and sitting positions, wherein:

the wheeled base comprises a base frame and wheels supporting the base frame for roiling movement along the ground;

the exoskeleton assembly comprises:

an upper portion arranged to be braced to a torso of a user;

an intermediate portion arranged to be braced to thighs of the user;

a hip joint pivotally coupling the intermediate portion to the upper portion;

a lower portion arranged to be braced to lower legs of user; and a knee joint pivotally coupling the lower portion to the intermediate portion;

the lower portion of the exoskeleton assembly comprises two independent lower leg members arranged to be braced to respective ones of the lower legs of the user;

the docking assembly comprises a pair of lower docking members arranged to be coupled to respective ones of the two lower leg members independently of one another, each lower docking member comprising an extensible link in the coupled position of the docking assembly which is extendible in length between the exoskeleton assembly and the wheeled base; and the extensible links are independently extendable relative to one another such that the lower docking members are arranged to remain coupled between the wheeled base and the exoskeleton assembly during a walking motion of the exoskeleton assembly.

20. The system according to claim 19 wherein each extensible link is pivotally coupled relative to the exoskeleton assembly and relative to the wheeled base.

* * * * *